US007322722B2

(12) United States Patent
Hartmann, Jr. et al.

(10) Patent No.: US 7,322,722 B2
(45) Date of Patent: Jan. 29, 2008

(54) LIGHT FIXTURE

(75) Inventors: Richard Hartmann, Jr., Holland, MI (US); Richard J. Camarota, Holland, MI (US)

(73) Assignee: ITC, Incorporated, Holland, MI (US)

( * ) Notice: Subject to any disclaimer, the term of this patent is extended or adjusted under 35 U.S.C. 154(b) by 44 days.

(21) Appl. No.: 11/176,470

(22) Filed: Jul. 7, 2005

(65) Prior Publication Data

US 2005/0225966 A1 Oct. 13, 2005

Related U.S. Application Data

(60) Provisional application No. 60/587,423, filed on Jul. 13, 2004.

(51) Int. Cl.
*F21V 15/00* (2006.01)

(52) U.S. Cl. ..... 362/365; 362/147; 362/311; 362/455

(58) Field of Classification Search ..... 362/145, 362/147, 364, 365, 368, 375, 440, 455, 549, 362/311, 404, 406, 362, 363, 148, 393, 430, 362/433, 434

See application file for complete search history.

(56) References Cited

U.S. PATENT DOCUMENTS 2,744,191 A * 5/1956 Renaud et al. ..... 362/375
D213,464 S 3/1969 Meyer
4,234,916 A * 11/1980 Goralnik ..... 362/294
4,290,098 A 9/1981 Pierson
4,487,495 A * 12/1984 Kimata et al. ..... 396/106
4,733,339 A 3/1988 Kelsall
D298,469 S 11/1988 Melrose
4,827,386 A * 5/1989 Mackiewicz ..... 362/267
4,954,932 A 9/1990 Isenga
4,969,073 A 11/1990 Isenga
5,272,603 A 12/1993 Camarota et al.
D347,293 S 5/1994 Roos et al.

(Continued)

FOREIGN PATENT DOCUMENTS

DE 2922190 A * 2/1980

(Continued)

OTHER PUBLICATIONS

"Courtesy Lighting" shows a "DayStar™ Dome Light" and "Low Profile Overhead Dome Light"—1 page, no date.

(Continued)

*Primary Examiner*—Sandra O'Shea
*Assistant Examiner*—Mary Zettl
(74) *Attorney, Agent, or Firm*—Jonathan P. O'Brien; Kelly T. Murphy; Miller Canfield Paddock and Stone

(57) ABSTRACT

A light fixture for flush mounting against a ceiling wall includes a housing for securement in a wall hole and a light transmitting lens. The lens is flush with the wall and covers the entirety of the housing so that the housing is not viewable when installed. The outer edge of the lens is out of line of sight relation with the light source, but provides illumination through radial transmission of light outwardly from a central portion of the lens. Movable tongues supported at opposing sides of the housing and grooves formed in a skirt of the lens removably join the lens to the housing.

13 Claims, 24 Drawing Sheets

U.S. PATENT DOCUMENTS

| | | | | |
|---|---|---|---|---|
| 5,314,148 | A | 5/1994 | Jones | |
| 5,477,442 | A | 12/1995 | Self | |
| 5,567,041 | A * | 10/1996 | Slocum | 362/148 |
| 5,568,008 | A * | 10/1996 | Narita | 313/113 |
| 5,609,414 | A | 3/1997 | Caluori | |
| D381,454 | S | 7/1997 | Lecluze | |
| D383,564 | S | 9/1997 | Lecluze | |
| 5,758,958 | A * | 6/1998 | Chen | 362/307 |
| 5,803,595 | A | 9/1998 | Verspaget et al. | |
| 5,813,744 | A * | 9/1998 | Altebarmakian | 362/470 |
| D399,590 | S | 10/1998 | Lecluze | |
| D407,524 | S | 3/1999 | Lecluze | |
| 6,042,251 | A * | 3/2000 | McCarthy et al. | 362/308 |
| 6,244,730 | B1 * | 6/2001 | Goldberg et al. | 362/268 |
| D445,526 | S | 7/2001 | Wang | |
| 6,312,145 | B1 | 11/2001 | Rhoad | |
| D457,677 | S | 5/2002 | Landefeld et al. | |
| 6,431,723 | B1 * | 8/2002 | Schubert et al. | 362/147 |
| 6,454,439 | B1 | 9/2002 | Camarota | |
| D464,164 | S | 10/2002 | Thompson | |
| 6,471,368 | B1 | 10/2002 | Lin | |
| 6,502,975 | B1 * | 1/2003 | Branstetter | 362/549 |
| D473,965 | S | 4/2003 | Lecluze | |
| D473,966 | S | 4/2003 | Lecluze | |
| 6,554,458 | B1 | 4/2003 | Benghozi | |
| D476,108 | S | 6/2003 | Lecluze | |
| 6,586,672 | B2 | 7/2003 | Kobus et al. | |
| 6,612,725 | B2 | 9/2003 | Camarota et al. | |
| 6,619,829 | B1 | 9/2003 | Chen | |
| 6,713,961 | B2 | 3/2004 | Honda et al. | |
| D488,251 | S | 4/2004 | Benghozi | |
| D488,583 | S | 4/2004 | Benghozi | |
| D490,183 | S | 5/2004 | Benensohn | |
| D493,246 | S | 7/2004 | Benensohn | |
| 6,827,471 | B1 | 12/2004 | Benghozi | |
| D516,235 | S | 2/2006 | Rashidi | |
| 7,070,306 | B2 | 7/2006 | Cousin | |
| 7,267,450 | B2 * | 9/2007 | Ha | 362/92 |
| 2003/0063470 | A1 * | 4/2003 | Grajetzky et al. | 362/365 |
| 2004/0120141 | A1 * | 6/2004 | Beadle | 362/147 |
| 2004/0246715 | A1 * | 12/2004 | Pearl | 362/226 |
| 2005/0162860 | A1 | 7/2005 | Su | |
| 2005/0265016 | A1 * | 12/2005 | Rappaport | 362/147 |

FOREIGN PATENT DOCUMENTS

| | | | |
|---|---|---|---|
| FR | 2442500 | A * | 7/1980 |
| JP | 2001160309 | A * | 6/2001 |

OTHER PUBLICATIONS http://itc-marine.com/court.html dated Jan. 9, 2003 shows a "Oval Flood/Stop Light" and "Oval Courtesy Light" (items 69400 and 80495, respectively)—2 pages.

http://itc-marine.com/overhead.html dated Jan. 9, 2003 shows a "Décor TM Premium Recessed Light" with retaining springs—3 pages.

http://itc-marine.com/exterior.html dated Jan. 9, 2003 shows a "Center High Mount Stop Light Five . . . " and a "Center High Mount Stop Light Linear . . . "—2 pages.

PERKO® . . . catalog No. 255 1988-1989 at p. 67 shows a "Surface Mount Light Fig. 318A"—2 pages.

file://C:\DOCUME~1\rjt\LOCALS~1\Temp\OQ5005VC.htm dated Oct. 6, 2005 shows a "Button LED Light" model 69500-W which was available to the public in the U.S. before Jul. 13, 2003—2 pages.

Page 1 of the present specification, including the margin marked paragraph entitled Background of the Invention, no date.

Drawing sheet showing Button Led Light Model 69500-W, no date.

* cited by examiner

LIGHT FIXTURE

This application claims the priority of U.S. Provisional Application Ser. No. 60/587,423 file date Jul. 13, 2007.

FIELD OF THE INVENTION

The present invention relates to a light fixture, and more specifically to a light fixture to be flush mounted on a surface.

BACKGROUND OF THE INVENTION

In one known light fixture, of flush mountable type, a hat-shaped housing has a cup-shaped central portion recessed in a mounting surface and a radially outwardly extending, surrounding brim seated on the mounting surface. A lens seats coaxially on the inboard portion of the brim. An opaque annular cover clamps the lens to the housing. The cover projects axially from the housing enough to hide the lens from view from the side.

SUMMARY OF THE INVENTION

The present invention relates to a flush mountable light fixture including a housing, adapted to contain a light source, and a light transmitting lens. In one embodiment, the lens is fixed directly to the housing. In another embodiment, the light transmitting lens includes a light transmitting peripheral portion out of line of sight relation with the light source. In another embodiment, the light transmitting lens overlaps the brim of the housing. In another embodiment, the outer periphery of the light transmitting lens is visible from the side.

DETAILED DESCRIPTION

Figure 27:
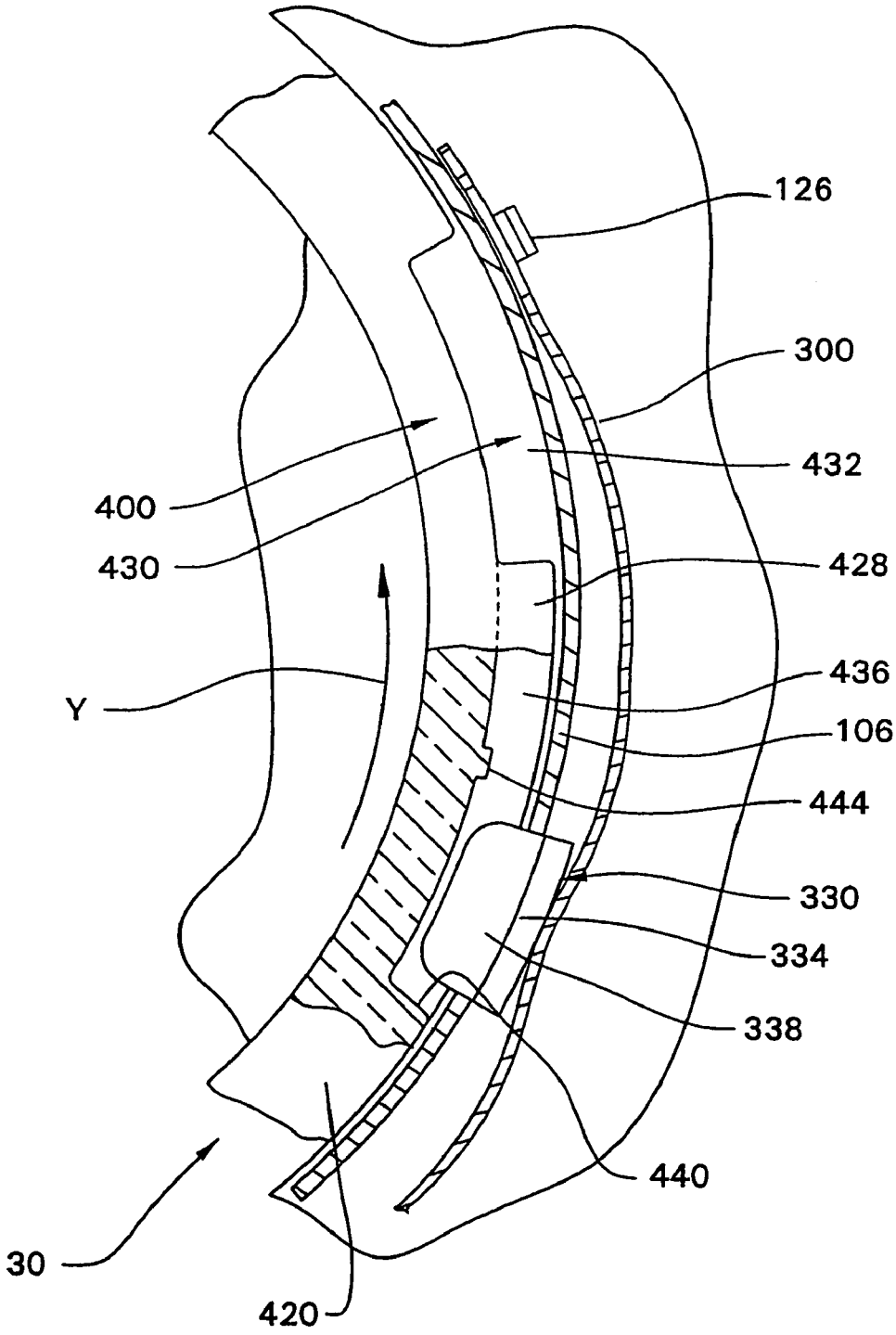
FIG. 27 is a schematic, partially broken, fragmentary cross sectional view of structure fixing the lens to the housing, generally as seen from the rear in FIG. 1.
Figure 30:
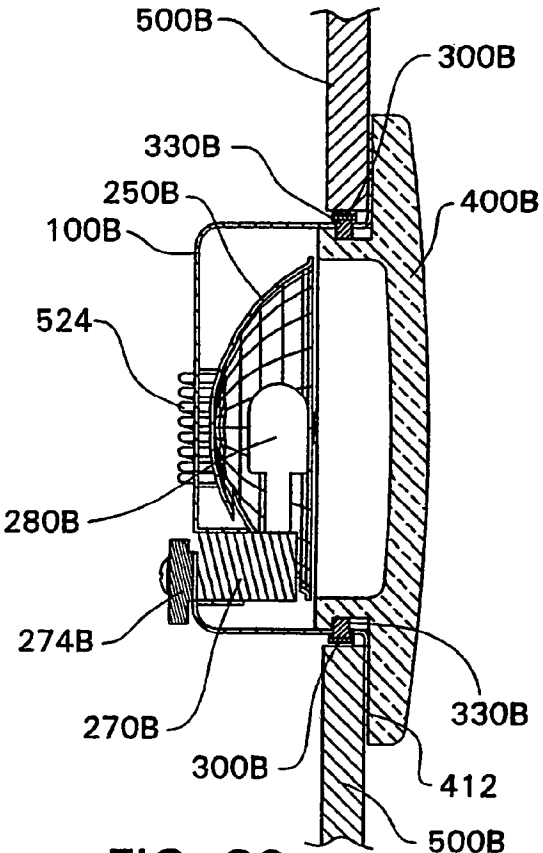
FIG. 30 is a cross sectional view taken substantially on the line 30-30 of FIG. 28, with the light fixture recessed in a mounting surface.
Figure 28:
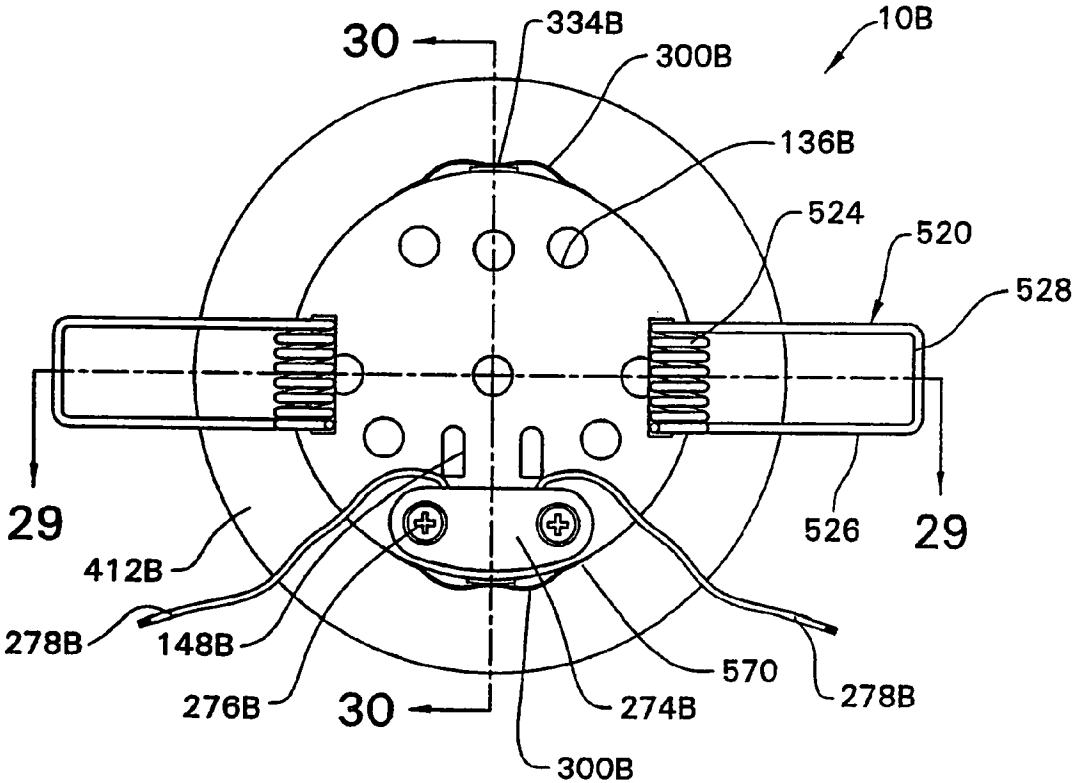
FIG. 28 is a rear view of a light fixture according to a second embodiment of the invention.

A light fixture 10 (FIGS. 1-5), embodying the present invention, comprises a housing 100, an installation structure 15 (FIG. 3) for fixed recessing of the housing 100 in a desired environmental surface (e.g. of a barrier such as a wall or ceiling of a dwelling, motor home or boat cabin), a light transmitting lens 400, lens/housing connector structures 30 (FIG. 27) for releasably fixing the lens 400 on the front of the housing, a reflector 250 fixed in the housing 100, and a light emitter mount 270 fixed with respect to the housing 100 to support a light emitter 280 between the reflector 250 and lens 400.

The housing 100 (FIGS. 1, 6-9) is preferably generally hat shaped and comprises a cup-like portion 104 defined by a generally cylindrical side wall 106, and an end wall 108 closing the rear of the cup-like portion 104. A flange, or brim, 110 extends radially outwardly from the front edge of the cup-like portion 104.

The housing 100 may be conventionally formed, as by deformation of sheet metal blank, by plastic molding, or the like.

The side wall 106 (FIGS. 7-9) has evenly circumferentially spaced, generally rectangular, circumferentially extended, tongue receiving throughholes 118 adjacent and equidistant from the brim 110 of the housing 100.

The side wall 106 (FIGS. 7-9) also includes a pair of leaf spring mounting apertures 120 circumferentially flanking each tongue receiving throughhole 118. Each leaf spring mounting aperture 120 (FIGS. 8 and 9), which is a part of the lens/housing connector structure 30, is defined by fingers 126 projecting outwardly from the circumference of the side wall 106 and tips 128 at the ends of the fingers 126. The tips 128 project toward each other in a direction substantially transverse to the axis of the aperture 120 and parallel to the side wall 106. The tips 128 are spaced apart and partially close the aperture 120. The leaf spring mounting apertures 120 are preferably equidistant from the respective through-hole 118 and spaced at the same distance from the brim 110 of the housing 100.

Reflector tab holes 130 (FIG. 8) are located in the cylindrical side wall 106. Generally flat reflector mounting tabs 132 (FIGS. 6 and 7) project generally radially inward from the upper edge of the respective tab holes 130 into the cup-like housing portion 104. The reflector tabs 132 include respective reflector mounting holes 134 formed therethrough.

A plurality of vent holes 136 (FIG. 6) are formed in the end wall 108 of the housing 100. The vent holes 136 are spaced from a circular central hole 142 of the end wall 108.

Several (e.g. three) fastener holes 140 (FIG. 6) in the end wall 108 are preferably equidistant from the central hole 142 and from each other and thus preferably lie symmetrically about the central hole 142.

Figure 6:
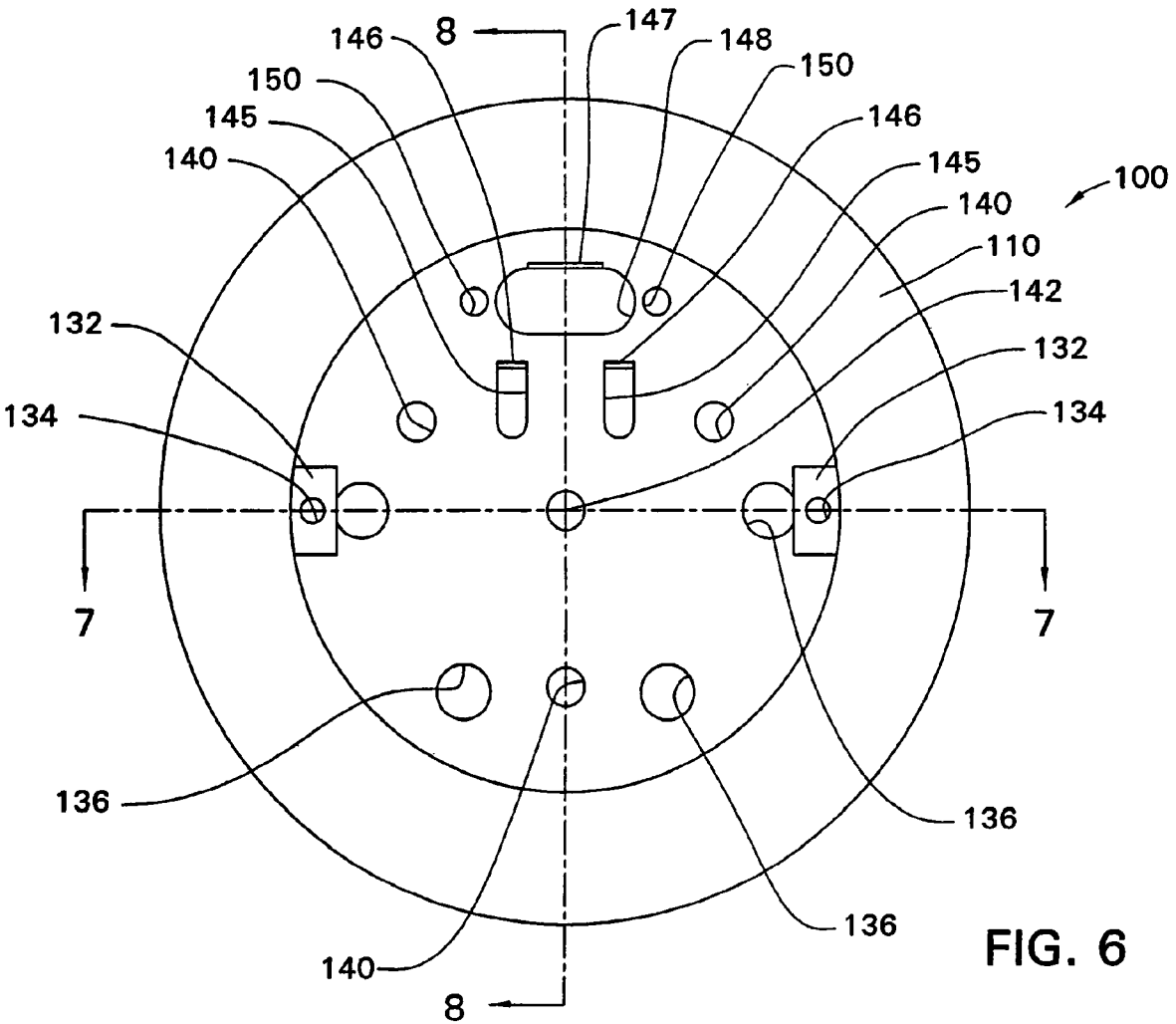
FIG. 6 is a front view of the FIG. 1 housing.
Figure 7:
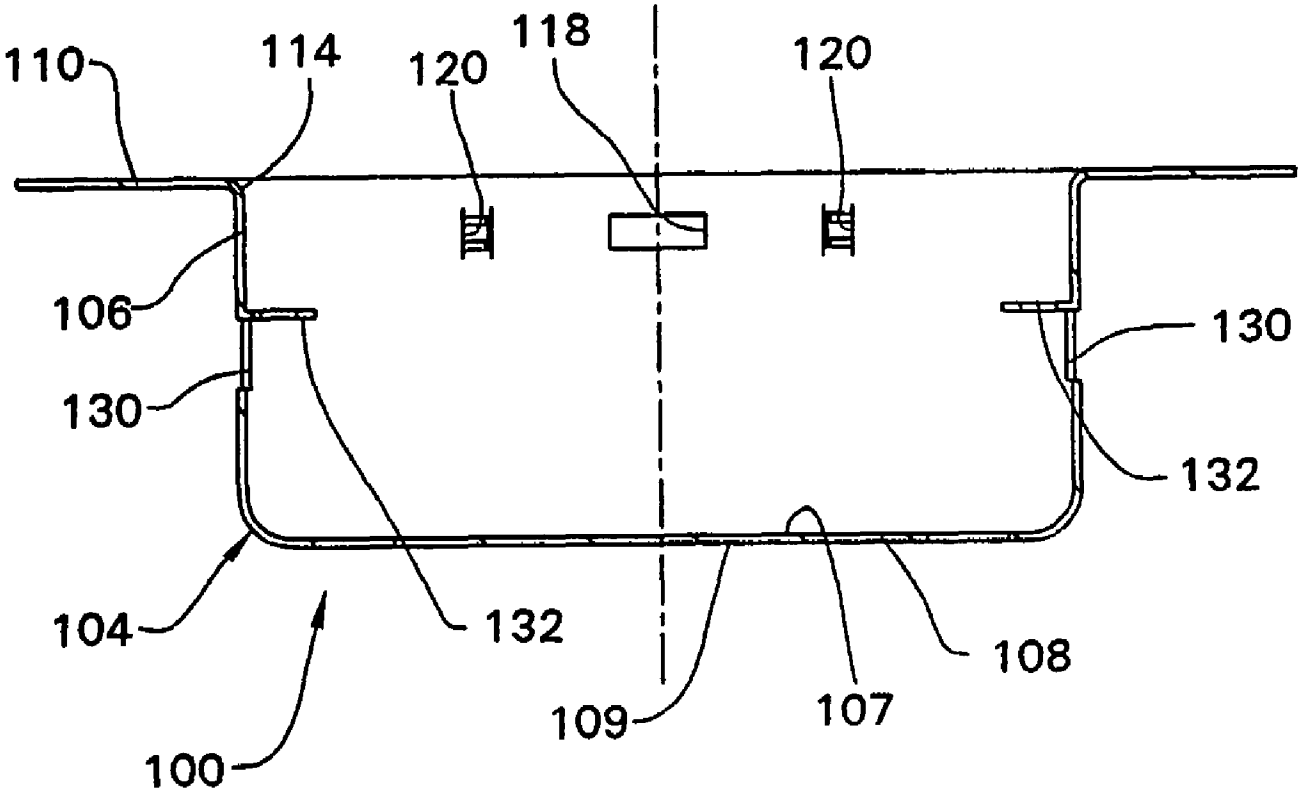
FIG. 7 is a cross sectional view taken substantially on the line 7-7 of FIG. 6.
Figure 8:
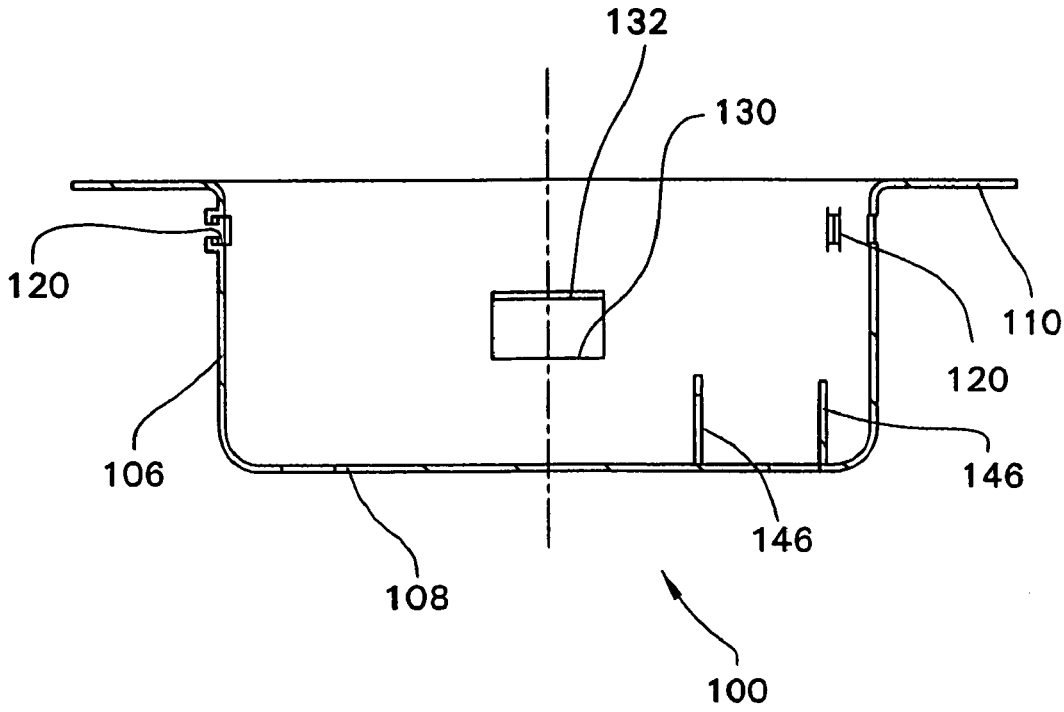
FIG. 8 is a cross sectional view taken substantially on the line 8-8 of FIG. 6.
Figure 9:
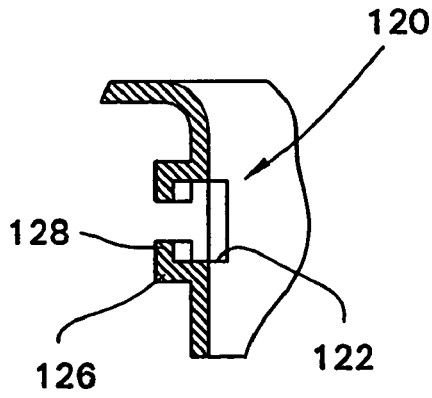
FIG. 9 is an enlarged fragment of FIG. 8.

The housing 100 (FIG. 6) includes elongate holes 145 formed in the end wall 108. Light emitter mount support prongs 146 (FIGS. 6 and 8), located at one end of each of the elongate holes 145, project into the cup-like housing portion 104 in a direction transverse to the end wall 108 (FIGS. 6 and 8).

An elongate light emitter mount hole 148 (FIGS. 6 and 8) in the end wall 108 is spaced from the holes 145 and adjacent the side wall 106. The hole 148 is here of oval shape. Another light emitter mount support prong 147 extends from the outboard edge of the hole 148 into the interior of the cup-like housing portion 104. The light emitter mount support prongs 146, 147 are spaced about the light emitter mount hole 148.

A pair of screw receiving holes 150 (FIG. 6) in the end wall 108 flank the ends of the elongate light emitter mount hole 148.

Figure 11:
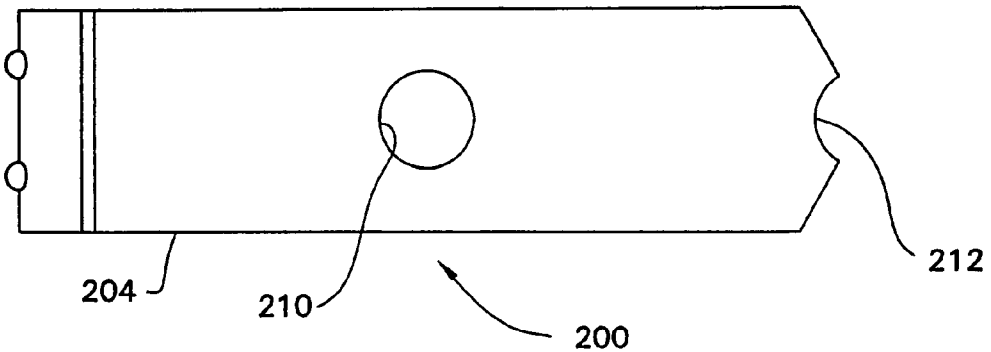
FIG. 11 is a face view of the FIG. 10 spring member.
Figure 10:
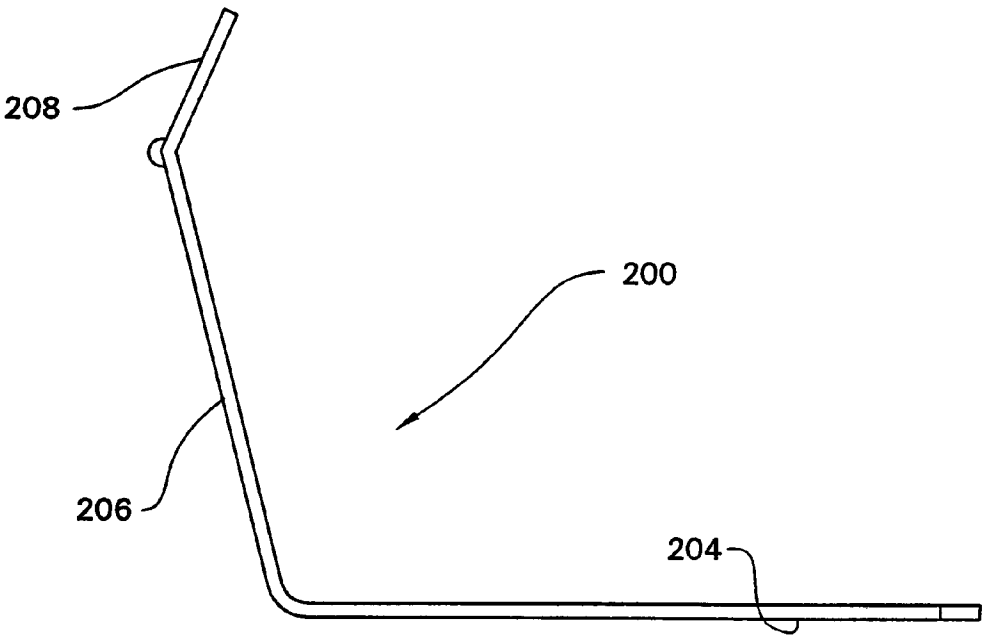
FIG. 10 is an edge view of an elastically bendable spring member of FIG. 1.

The installation structure 15 (FIG. 1) here comprises several, preferably three, evenly circumferentially spaced, elongate, generally C-shaped, elastically bendable, leaf spring members 200 (FIGS. 10 and 11). Each leaf spring member 200 includes a base portion 204, middle portion 206 and end portion 208. The middle portion 206 angles with respect to the base portion and end portion 208 in its rest condition. The base portion 204 includes a hole 210 spaced between its ends and semicircular notch 212 at its free end.

The spring member base portions 204 (FIGS. 3 and 4) are fixed in radially extending, evenly circumferentially spaced relation to the rear face of the end wall 108 of the housing 100, here by fasteners (e.g. rivets) 216 extending through the spring holes 210 and fastener holes 140, and a central fastener (e.g. rivet) 218 extending through the adjacent notches 212 of the three spring member base portions 204 and the central hole 140 in the end wall 108 of the housing.

Figure 12:
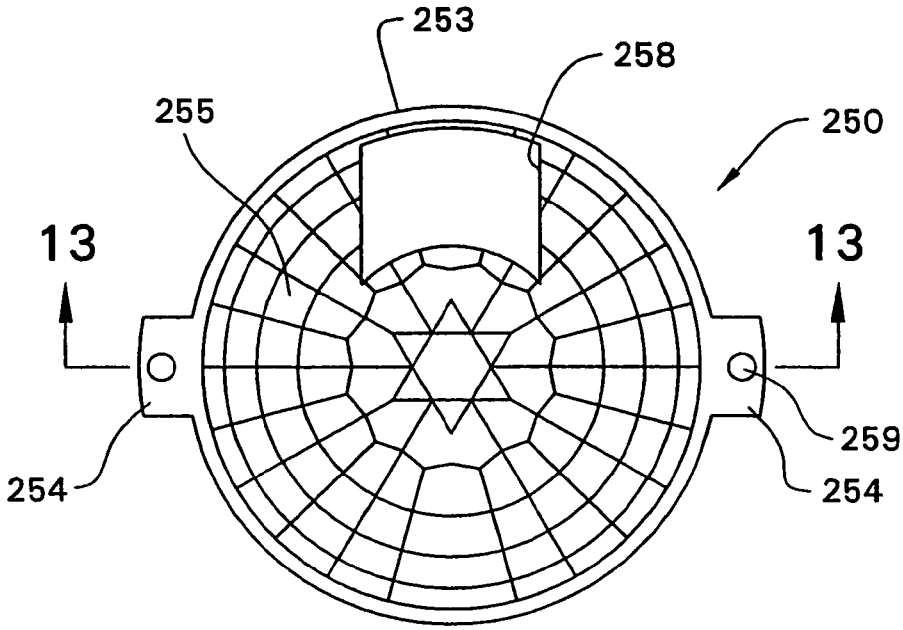
FIG. 12 is a front view of the reflector of FIG. 1.
Figure 13:
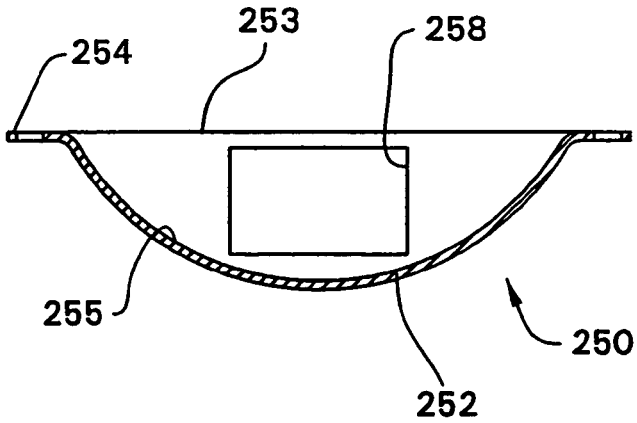
FIG. 13 is a cross sectional view taken substantially on the line 13-13 of FIG. 12.

The reflector 250 (FIGS. 12 and 13) includes a front opening central bowl 252 having a front facing reflective surface 255 and a radially extending front rim 253. While the rim 253 may be of constant radial width, in the preferred embodiment shown, mounting ears 254 protrude radially from opposing sides of an otherwise narrow rim 253 and mounting holes 259 are located in the ears 254. The bowl 252 includes an eccentrically located, generally rectangular lamp holder hole 258.

A preferably conventional, generally rectangular, light emitter mount 270 (FIGS. 4 and 5) is slidably sandwiched between the light emitter mount support prongs 146 and 147 with its rear end abutting the interior face 107 of the end wall 108 of the housing 100.

A clamp plate 274 abuts the rear face 109 of the housing end wall 108. Screws 276 extend through the plate 274 and thread into the light emitter mount 270, to clamp the light emitter mount 270 to the housing end wall 108 and thus fixedly within the housing 100. Insulated wires 278 (FIG. 1) extend to the light emitter mount 270 and are fixed by the clamp plate 274.

The light emitter 280 may be of any desired kind. However, for present availability, low cost, small size and bright light output, a conventional halogen bulb is preferred. The light emitter 280 removably connects to the light emitter mount 270 in a conventional manner. The light emitter 280 extends from the mount 270 radially inward to lie at the focal point of the reflector 250 in a generally conventional manner.

The lens/housing connector structure 30 (FIGS. 16-21) here is generally of tongue and groove bayonet type.

Figure 15:
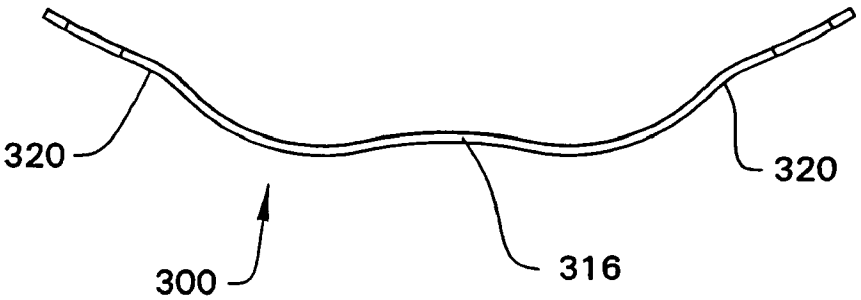
FIG. 15 is an edge view of the leaf spring of FIG. 14.
Figure 14:
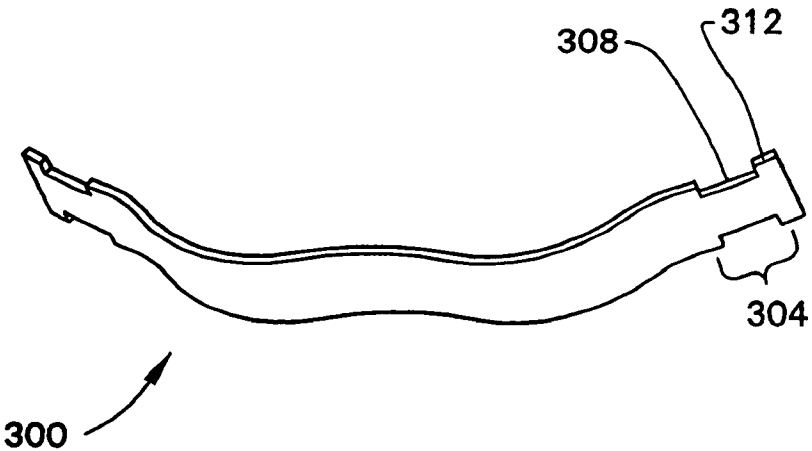
FIG. 14 is a pictorial view of a leaf spring of FIG. 1.
Figure 17:
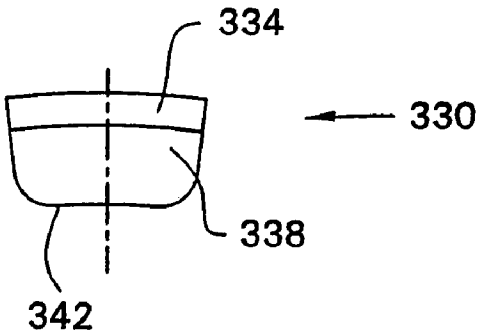
FIG. 17 is a front view of the tongue unit of FIG. 16.
Figure 18:
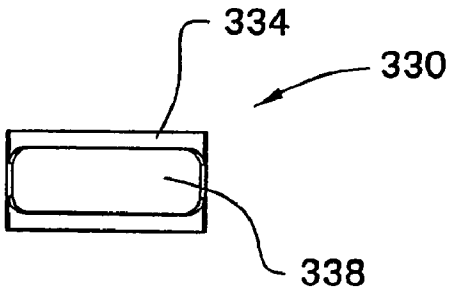
FIG. 18 is an inboard end view of the tongue unit of FIG. 16.
Figure 16:
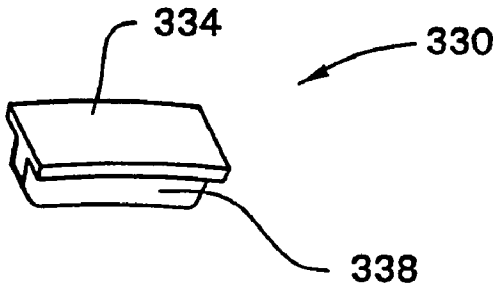
FIG. 16 is a pictorial view of a tongue unit of FIG. 1.
Figure 21:
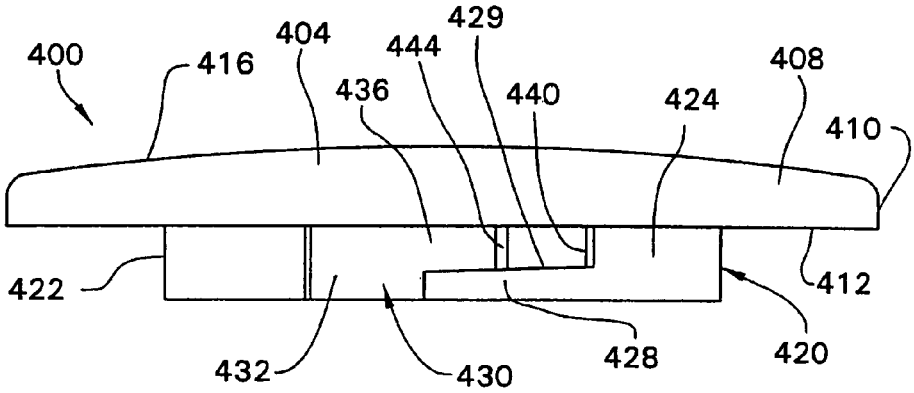
FIG. 21 is a side view of the lens of FIG. 19.
Figure 19:
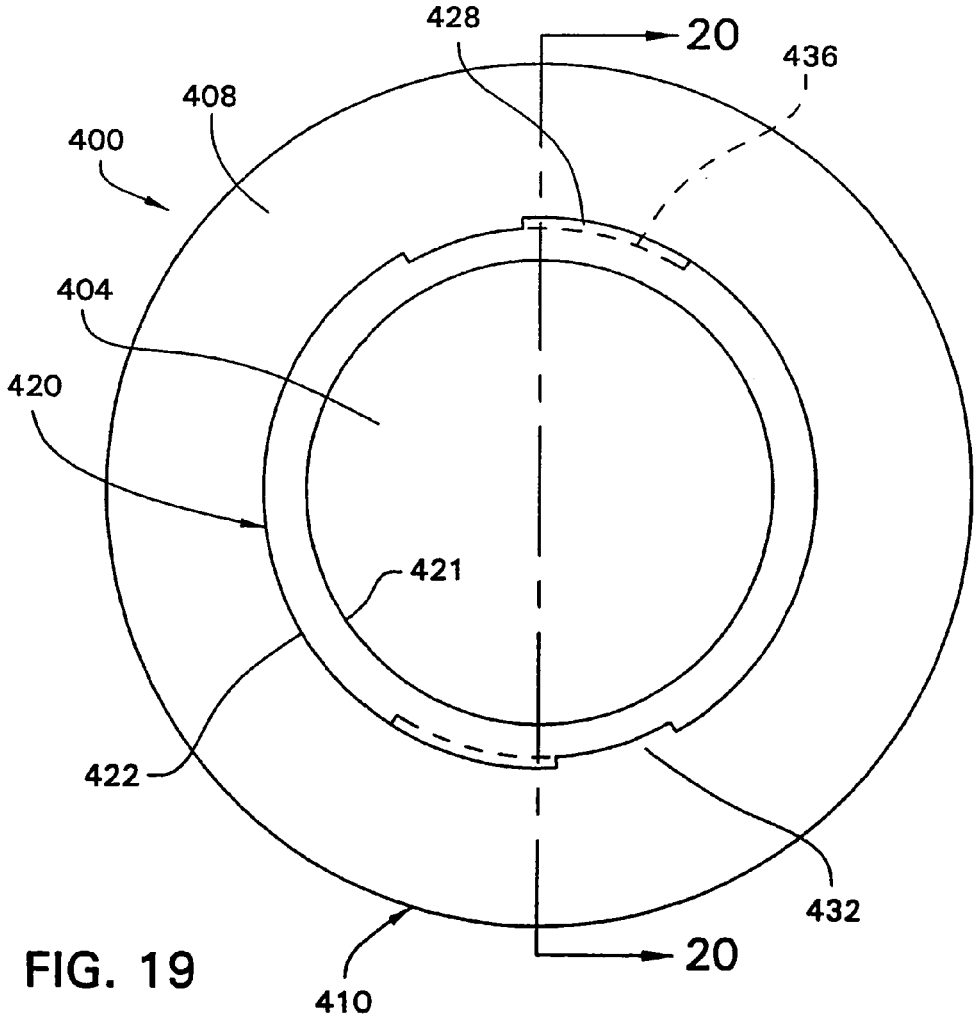
FIG. 19 is a rear view of the lens of FIG. 1.
Figure 20:
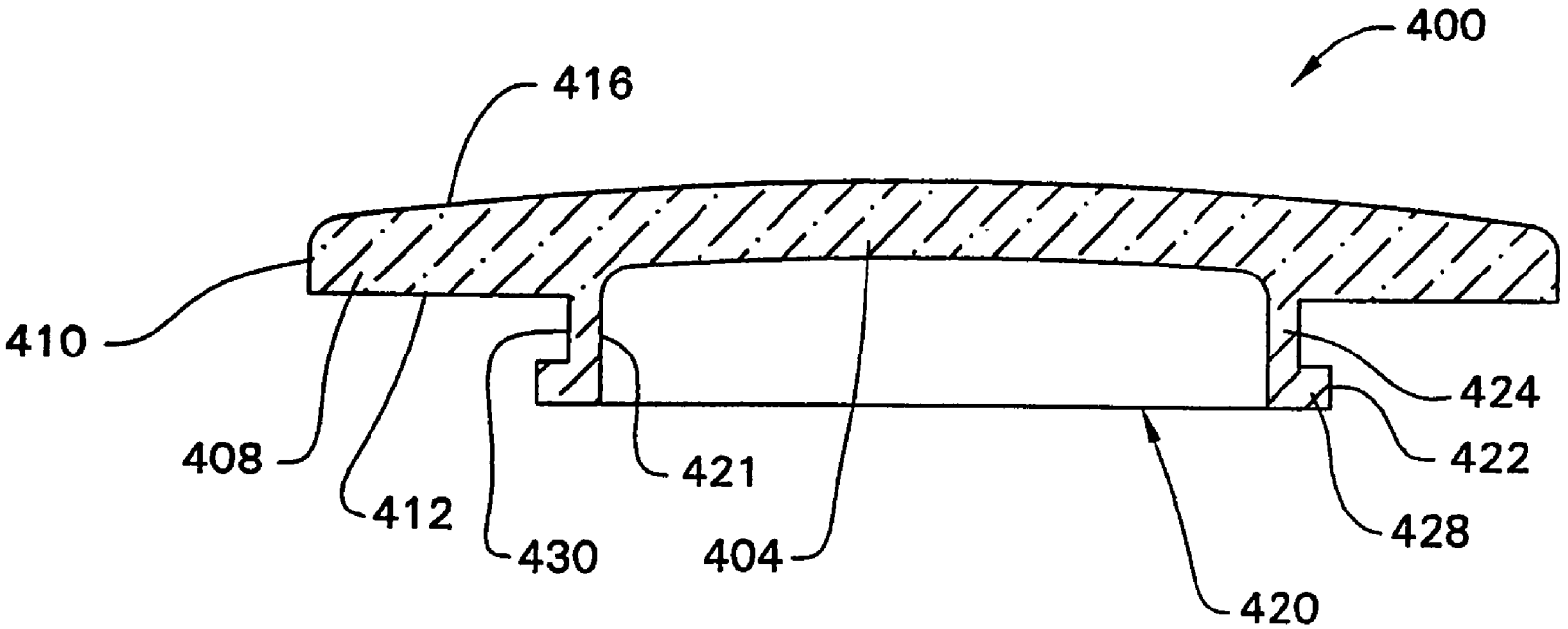
FIG. 20 is a cross-sectional view taken substantially on the line 20-20 of FIG. 19.

Each connector structure 30 here includes a generally W-shaped leaf springs 300 (FIGS. 14 and 15) which comprises a curved central portion 316 and oppositely curved flanking portions 320 ending in feet 304. Each foot 304 includes oppositely laterally opening notches 308 and oppositely facing, laterally extending toes 312. The leaf spring 300 is preferably bilaterally symmetrical.

Each connector structure 30 further includes a tongue unit 330 (FIGS. 16-18) which comprises a plate-like, rectangular base 334 from the central portion of which extends a reduced cross-section, elongate tongue 338, ending in a free end 342.

The lens 400 (FIGS. 19-21) includes a central portion 404 and a peripheral portion 408. The lens 400 has a rear face and a forward face 416. The forward face 416 (FIG. 5) of the lens 400 here shown is slightly convexly rounded and so tapers toward its peripheral edge 410. However, the lens 400 may have other shapes, e.g. with a front surface that is flat or has different radii of curvature in its central portion 404 and peripheral portion 408. The lens 400 has an annular, coaxial skirt 420 that projects rearward from the rear face 412 of the lens 400, at the joinder of the central portion 404 and the peripheral portion 408. The skirt 420 has inner and outer peripheral faces 421 and 422.

The connector structure 30 further includes at least one (here two) L-shaped, shallow, generally rectangular cross-section groove 430 (FIGS. 19-21 and 27) in the outer peripheral face 422 of the lens skirt 420.

More specifically, the L-shaped groove 430 includes a rearwardly open entry channel 432 whose forward end opens into one end of a circumferential channel 436. The circumferential channel 436 is located between the foot structure 428 and the rear face 463 of the outer rim 462 of the lens.

The foot structure 428 includes a camming ramp 429 that extends along a side of the circumferential channel 436. The circumferential channel 436 has a blind end 440 circumferentially spaced from the entry channel 432. A locking rib 444 (FIGS. 21 and 27) axially spans, and has a radial height about one third the radial depth of, the circumferential channel 436.

In the preferred embodiment shown, two such structures 30 are diametrically opposed. More than two such structures 30, preferably evenly circumferentially spaced, can be used but at greater cost and complexity and no apparent improvement in performance.

Each tongue unit 330 (FIG. 27) is installed on the outside of the housing as follows. The tongue 338 is inserted into a corresponding hole 118 in the housing side wall 106 so that the tongue 338 extends radially inboard into the housing interior.

The feet 304 (FIGS. 7 and 9) of the leaf springs 300 insert into the corresponding spaced leaf spring mounting apertures 120 in the housing side wall 106. Each foot 304 is inserted into its aperture 120 sufficient that the housing fingers 126 are locked in the spring notches 308 to fix the ends of the leaf spring 300 to the side wall 106 of the housing 100 as in FIG. 3.

The central portion 316 of the leaf spring 300 resiliently pushes the base 334 of the tongue unit 330 inboard against the outer face of the housing side wall 106 and so resiliently maintains the tongue 338 in the throughhole 118 and projecting into the cup-like interior of the housing 100.

Screws 260 through the reflector mounting holes 134 in reflector tabs 132 threadedly engage the mounting holes 259 of the housing ears 254 (FIG. 4) to fix the reflector 250 in the housing 100.

With the generally C-shaped springs 200, generally W-shaped springs 300, tongue units 330, light emitter mount 270, and reflector 250 mounted on the housing as above described, the lens 400 may be fixed to the housing 100, as follows.

The lens 400 is moved coaxially rearward toward the front of the housing and the skirt 420 is telescopically inserted into the front opening 114 of housing 100, with the entry channels 432 (FIGS. 21 and 27) in the skirt 420 in axial alignment with the corresponding tongues 338 on the housing 100.

Such rearward motion ends when the peripheral portion 408 of the lens abuts the front face of the housing flange 110 and the tongues 338 project into the front portions of the entry channels 432 of the lens and are in circumferential alignment with the corresponding circumferential channels 436. The lens 400 is then rotated in the direction Y (FIG. 27) with respect to the housing 100 so that the circumferential channels 436 circumferentially advance and receive the corresponding tongues 338. Each locking rib 444 circumferentially advances past the corresponding tongue 338 by radially outwardly camming the tongue unit 330 against the resilient resistance of the leaf spring 300.

As the lens 400 rotates in the direction Y with respect to the housing 100, the camming ramp 29 engages the tongue 338 against the foot structure 428. As the rotation continues, the lens 400 is forced toward the housing brim 110 to provide a snug fit therebetween.

Figure 1:
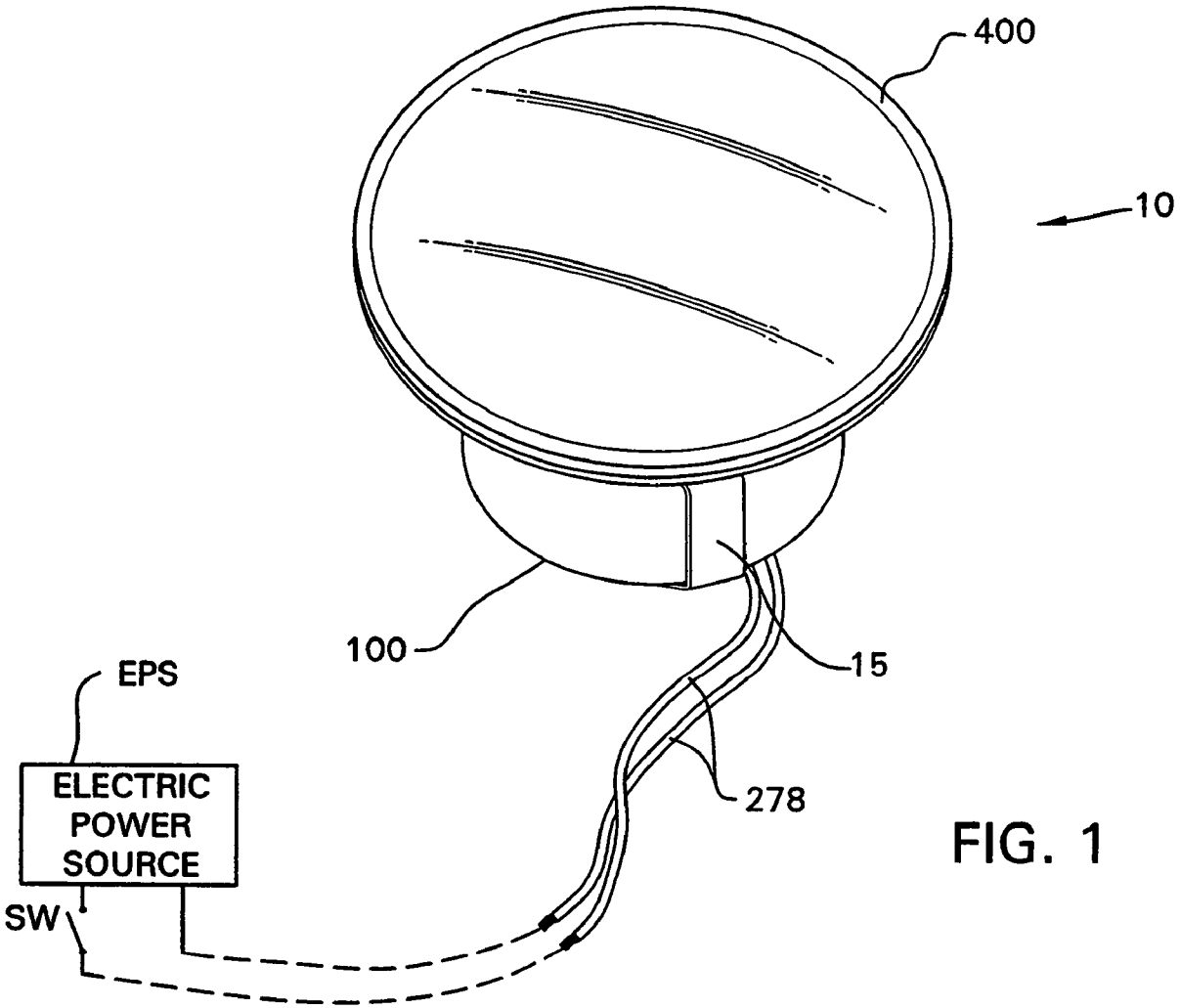
FIG. 1 is a pictorial view of a light fixture embodying the present invention.
Figure 2:
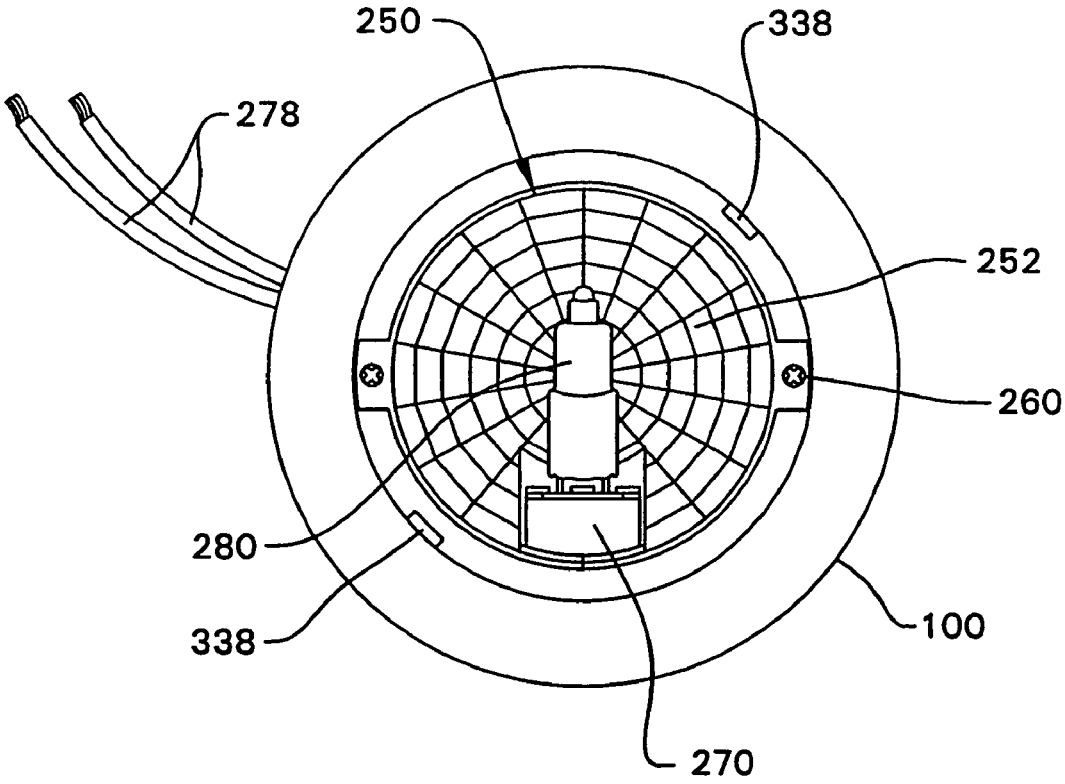
FIG. 2 is a front view of the FIG. 1 light fixture with the light transmitting lens removed.
Figure 4:
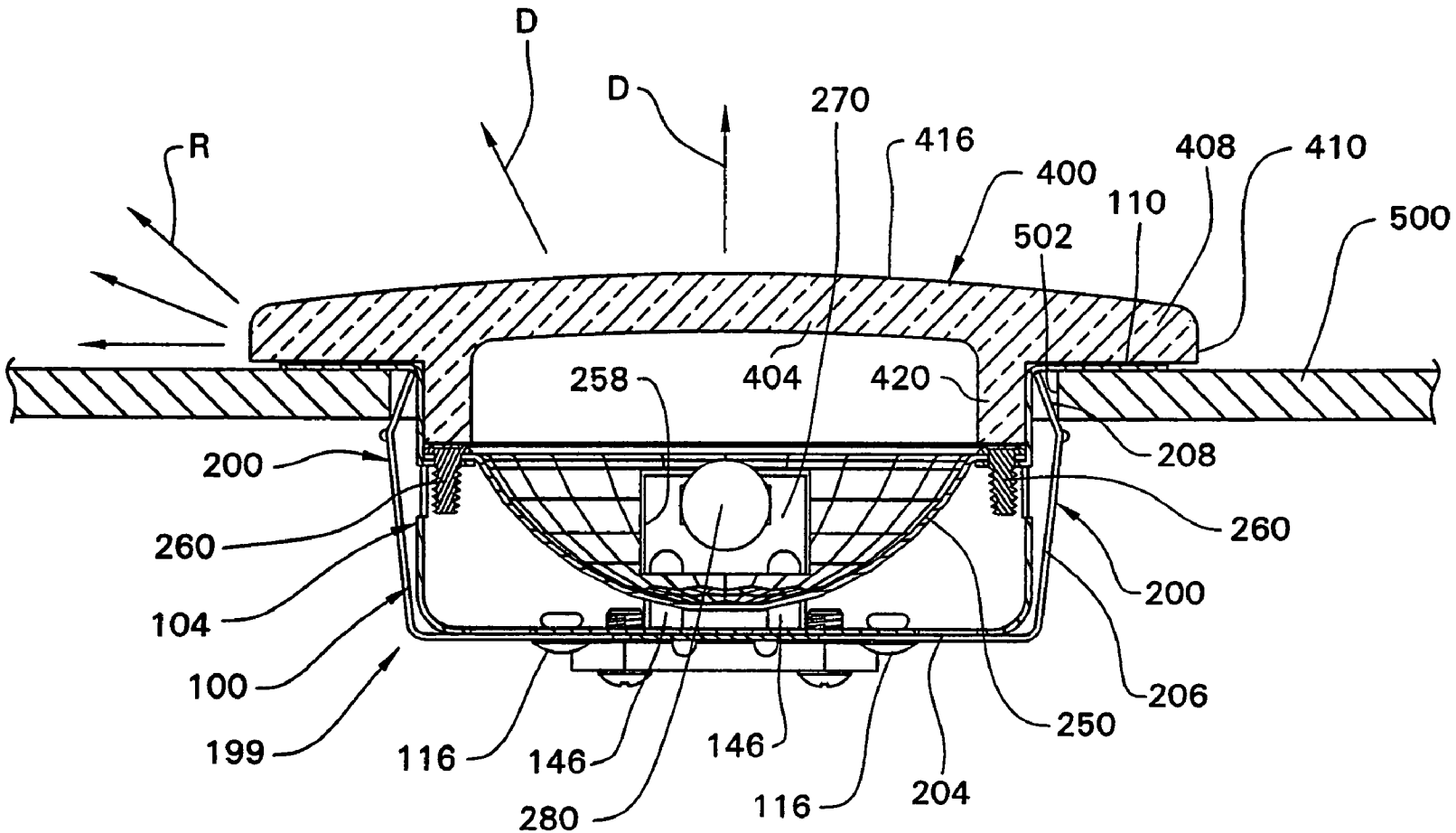
FIG. 4 is a schematic cross sectional view taken substantially on the line 4-4 of FIG. 3, with the light fixture recessed in a mounting surface and the leaf spring members repositioned in the cutting plane for purposes of illustration.
Figure 5:
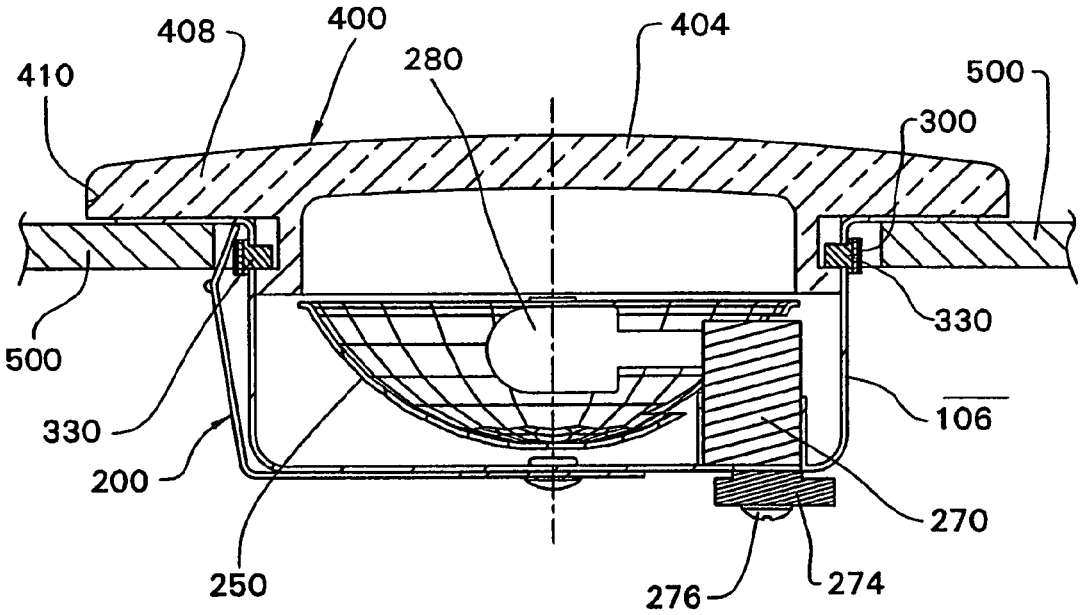
FIG. 5 is a cross sectional view taken substantially on the line 5-5 of FIG. 3, with the light fixture recessed in a wall.

Continued rotation of the lens 400 traps the tongue 338 in the circumferential channel 436 between the locking rib 444 and blind end 440 thereof, where it resiliently presses radially inward against the peripheral wall of the circumferential channel 436, and prevents escape of the lens 400 from its FIGS. 1, 4 and 5 position on the front of the housing 100.

The lens can be of desired conventional material. However, the preferred halogen light emitter operates at a high temperature. Thus, the lens must be of heat resistant material e.g. heat resistant glass. Applicants' have found that boron silicate glass has advantageous heat resistant and aesthetic qualities. Thus, the preferred lens 400 is of a tempered, cast boron silicate glass. This material is very heat resistant and compatible with a close spaced halogen light emitter.

Unfortunately, casting of a lens of boron silicate glass material is imprecise. Thus individual lenses may vary in shape and size within relatively great tolerances.

Thus, Applicants' discovered that such a lens 400 cannot be reliably fixed to a housing with a rigid connection structure. For example, the entry channel 432 on different lenses may vary in depth enough to not receive a rigid housing protrusion, or too loosely receive same and so risk having the lens fall off the housing.

To overcome that problem, the present invention provides novel, flexible tongue and groove arrangements that enable easy and secure fixing of the lens 400 to the housing 100. More specifically, by radially movably mounting the tongue unit 330 and biasing it with the leaf spring 300, the tongue 338 can reliably enter and seat in lens skirt grooves 430 of widely varying radial depth and effective diameter. Therefore, lenses 400 of wide manufacturing tolerances can be properly installed on a given housing. The lens 400 may be of other materials (e.g. other glass) having similar characteristics, including heat resistance.

Installation

The light fixture (FIGS. 4 and 5) is intended to flush mount on the front surface of a barrier 500, as follows. The barrier 500 has a through hole 502, (preferably circular) of width less than the brim 110 and more than the cup-like portion 104 of the housing 100.

The cup-like portion 104 of the housing 100 is pushed rearwardly into the hole 502 in the barrier 500. The rim of the hole 502 bends the spring member middle portions 206 and end portions 208 resiliently radially inward as the housing cup-like portion 104 moves rearwardly in the hole 502. Finally, the housing flange 110 abuts the front face of the barrier 500, and the spring members 200 resiliently bear against the rear barrier face and/or the periphery of the hole 502, to resiliently firmly trap the housing flange 110 against the front of the barrier 500.

Thereafter, or before if desired, the wires 278 (FIGS. 1 and 2) are connected to a suitable electrical circuit (e.g. as schematically shown in FIG. 1, through a switch SW to an electric power source EPS) for selectively electrically powering the light emitter 280 in a conventional manner.

The housing 100 may be so installed with or without the lens 400 thereon. The lens 400 can be installed and removed with respect to the housing 100, even with the housing mounted on a barrier 500.

Operation

The light emitter 280 is conventionally switched on, and energized through the switch SW and electric power source (e.g. 12V DC) EPS. Light emitted from the energized light emitter 280 is variously directed toward, and reflected by the reflector 250 (FIG. 4) to enter the opposed central portion 404 and skirt 420 of the lens 400. Some of this entering light is emitted through portions of the lens in line of sight relation to the light emitter 280, as indicated by the arrow D (FIG. 4), but peripheral portions of the lens 400 are not in line of sight relation with the light emitter 280, being blinded by the joinder of the housing side wall 106 and brim 110. However, a portion of the entering light is refracted by and reflected within the lens 400 and so angles radially outwardly from at least the outer part of the lens peripheral portion 408, including at the peripheral edge 410 of the lens, as generally indicated by the arrows R. In this manner, the entire visible part of the lens 400 is seen to glow and provides illumination forwardly and sidewardly, while hiding the housing flange 110 from view. Thus, the viewer sees an aesthetically pleasing, glowing, disk-like member protruding slightly from the front surface of the barrier 500. A series of these glowing disks, spaced e.g. along the wall or ceiling of a hallway, presents a novel and pleasing appearance, as well as marking the path through and lighting the hallway.

Modifications

Figure 23:
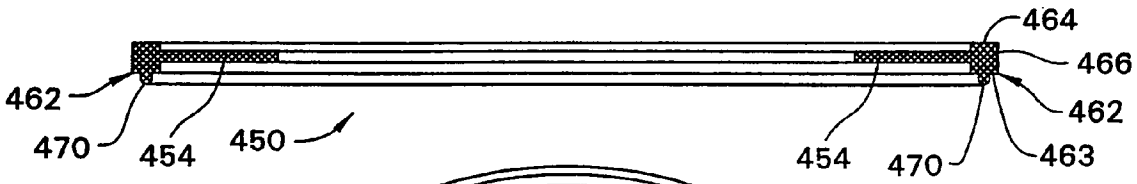
FIG. 23 is a cross-sectional view taken substantially on the line 23-23 of FIG. 22.
Figure 22:
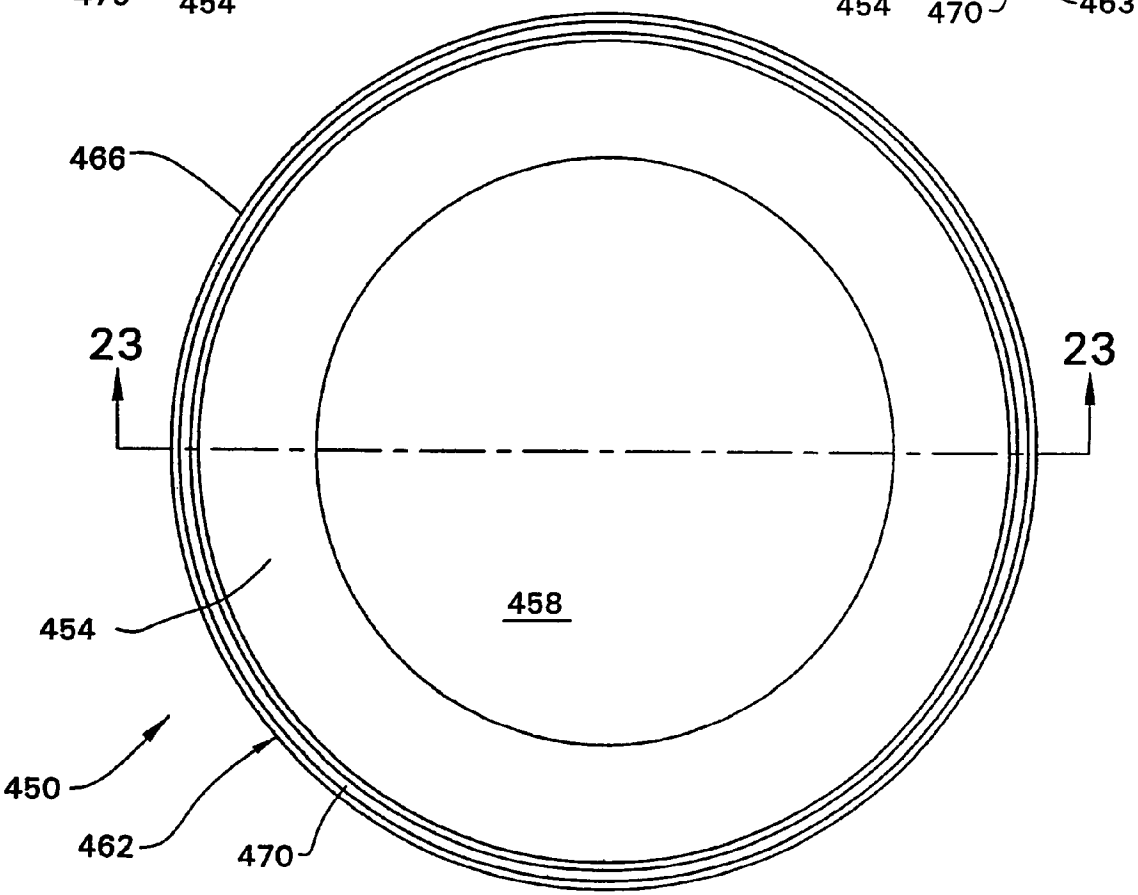
FIG. 22 is a rear view of a resilient mount seal ring useable with the FIG. 1 fixture.

A resilient mount seal ring 450 (FIGS. 22 and 23) includes a generally flat, washer-like body 454, a central opening 458 and a thickened, radially outer rim 462. The rim 462 projects frontwardly and rearwardly from the body 454 and has a substantially rectangular cross section, with a radially outer edge 466, a front face 464, and a rear face 463. An annular ridge 470 projects axially from the rear face 463.

The central opening 486 of the resilient mount seal ring 450 has a diameter that is slightly greater than the outer diameter of the housing side wall 106 to receive the housing cup-like portion 104 therethrough. The different diameter enables the seal ring 450 to slide along the side wall 106 and into abutment against the flange 110. The rim 462 has an inner diameter sized to snuggly radially receive the outer diameter of the housing flange 110. The mount seal ring 450 is most easily assembled on the housing cup-like portion 104 before installation thereon of the leaf spring members 200, leaf springs 300, and tongue units 334. The thus assembled mount seal ring 450 closely surrounds the housing cup-like portion and abuts the rear face of the housing brim 110.

Figure 24:
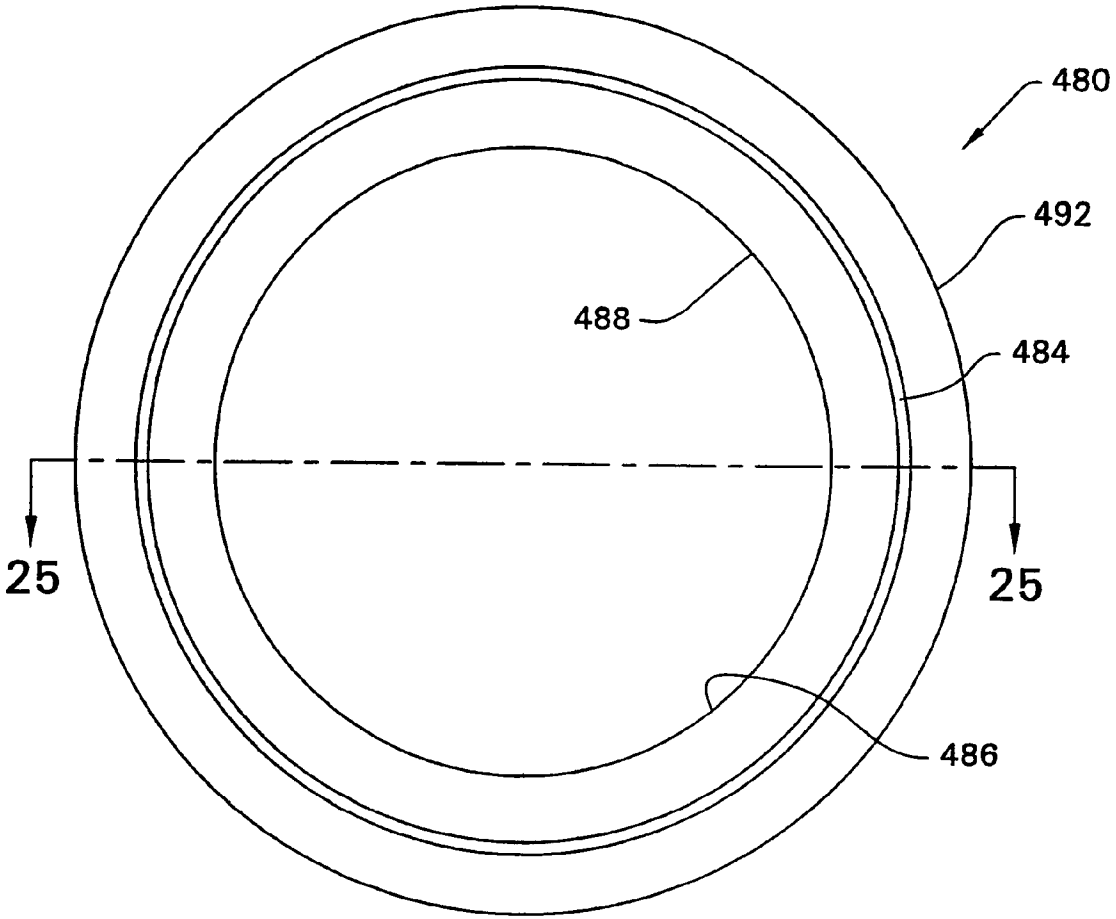
FIG. 24 is a front view of a resilient lens seal ring useable with the FIG. 1 fixture.
Figure 25:
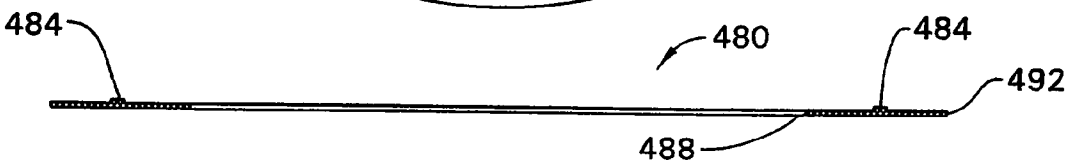
FIG. 25 is a cross sectional view taken substantially along the line 25-25 of FIG. 24.

A resilient lens seal ring 480 (FIGS. 24 and 25) has a substantially flat washer-like body 482, a central opening 486, and a forward projecting, coaxial annular rib 484 spaced radially between (e.g. here substantially equidistant from) the edge 488 of the central opening 486 and the outer peripheral edge 492 of the lens sealing ring 480.

The central opening 486 of the lens seal ring 480 has a diameter enough greater than the outer diameter of the lens skirt 420 to receive the latter therethrough and enough greater than the side wall 106 as not to shade light emitted from the housing.

Figure 26:
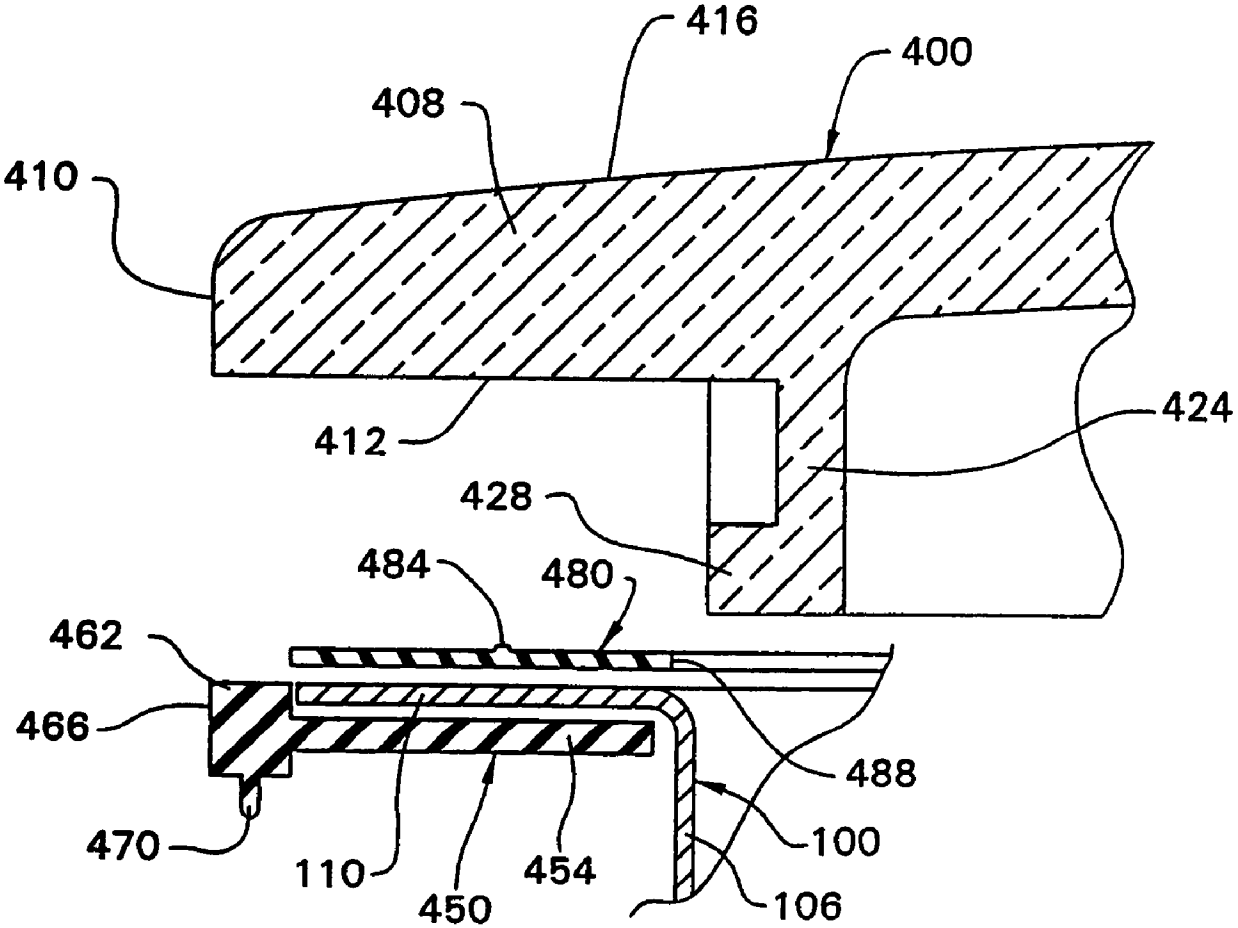
FIG. 26 is an enlarged, exploded, fragmentary central cross sectional view relating the FIG. 1 lens and housing, and the FIGS. 22 and 24 seal rings.

To assemble, the lens skirt 420 (FIG. 26) enters rearwardly through the central opening 486 of the lens seal ring 480 into the front opening cup-like portion 104 of the housing 100. Upon complete entry, the lens seal ring 480 is sandwiched between the rear face 412 of the peripheral portion 408 of the lens and the front face of the brim 110 of the housing 100. When the lens 400 is rotated, the tongue 338 engages the camming ramp 429 to move the lens axially toward the housing brim 110, and so to compress the lens seal ring 480 sealingly between the brim 110 and the lens peripheral portion 408. The protruding annular rib 484 of the lens seal ring 480 is thus most forceably sealingly compressed against the rear face 412 of the lens peripheral portion 408. The result is to seal against water entry into the fixture 10 between the lens 100 and housing brim 110.

With the light fixture 10 flush mounted on the barrier 500, substantially as above described, the flat annular body 454 of the mount seal ring 450 is snuggly sealingly sandwiched between the housing brim 110 and the front of the barrier 500, and the expanded outer rim 462 of the mount seal ring snugly surrounds the peripheral edge of the housing brim 110.

The outer edge 466 of the mount seal ring 450 (FIG. 26) and the peripheral edge 410 of the lens 400 preferably have substantially the same diameter, such that the lens 400 overlies the mount seal ring's enlarged outer edge 466.

While the lens peripheral edge 410 could project radially beyond the mount seal ring outer edge 466 and so even further hide the latter, such may make the lens peripheral edge more vulnerable to damage and so is less preferred.

Preferably the expanded outer rim 462 extends forward slightly beyond the housing brim 110 and the flat body 482 of the lens seal ring 480 to the front plane of the annular rib 484 or very slightly (e.g. 0.1 mm) therebeyond. Thus, upon installation of the light fixture 10 in the barrier hole 502, the lens 400 presses sealingly against both the lens seal ring 480 and the expanded outer rim 462 of the mount seal ring 450. Thus, the radially inner and outer parts of the mount seal ring 450 are pressed sealingly against the front of the barrier 500 by the housing brim 110 and lens 400, respectively.

The seal rings 450 and 480 thus prevent entry of water into the light fixture 10 and through hole 502 into the space behind the barrier 500, and so avoid water damage to and electrical shorting of the light fixture 10, and water damage in the space behind the barrier.

A modified fixture 10B (FIGS. 28-35) is preferably similar to the fixture 10 except as follows. Structural elements of the fixture 10B, generally corresponding to structural elements of the fixture 10, carry the same reference numerals with the suffix B added.

The fixture 10B has modified installation structures 15B and/or modified structure to mount the W-shaped leaf springs 300.

The installation structure 15B is substantially conventional. It includes generally T-shaped coil spring recesses 540 (FIG. 31) in the edge of the end wall 108B of the housing 100B and communicating with generally T-shaped, coil spring recesses 550 in the rear edge portion of the side wall 106B of the housing 100B (FIG. 33), at the ends of recess legs 544 and 554 located at the join of the housing rear end wall 108B and side wall 106B. Thus, the recesses 540, 550 define a single, generally H-shaped, coil spring hole 540, 550 in the housing 100, leaving circumferentially opposed, spring mounting projections 556. Cross heads 542 and 552 of the T-shaped recesses 540 and 550 are spaced inboard on end wall 108B and side wall 106B, respectively, and by the opposed spring mounting projections 556.

Conventional "rat-trap" style, resilient wire, spring members 520 (FIG. 34) each comprise a coil 524, an arm 526 at one end of the coil 524 extending radially from the coil axis 522, a bight 528 parallel to and substantially the length of the coil 524, a further, return arm 526 parallel to the extending arm 526 and returning back toward the axis 522, and a finger 530 entering the other end of the coil 524.

To mount each coil spring member 520 onto the housing 100, the coil 524 is axially compressed, inserted between the opposed projections 556 (FIGS. 34 and 35), allowed to axially expand (relax) in telescoped relation over the projections 556, and thus trap the coil spring member 520 on the housing 100, with finger 530 fixedly engaging the projections 556 to resiliently urge the spring arms 526 forward toward and adjacent the housing brim 412.

Figure 29:
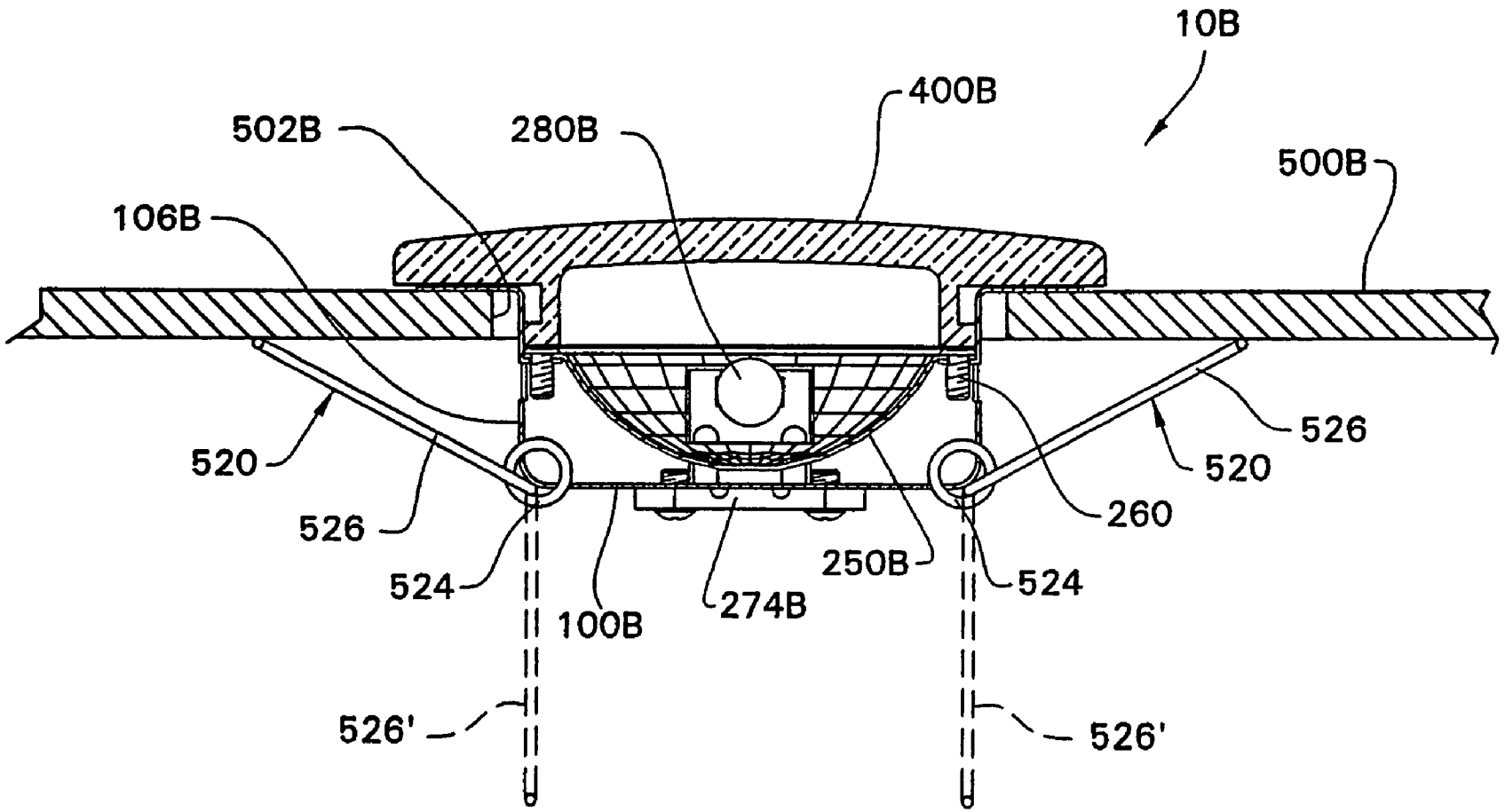
FIG. 29 is a cross sectional view taken substantially on the line 29-29 of FIG. 28, with the light fixture recessed in a mounting surface.

During installation of the fixture 10B rearwardly into the hole 502 in the barrier 500, the installer forces the spring arms 526 to extend rearwardly, as indicated in broken lines at 526' in FIG. 29, and inserts same, followed by the cuplike portion of the housing, rearwardly into the hole 502. As the housing brim 110 comes to rest against the front of the barrier wall, the free ends of the spring arms 526 relax toward the inner surface of barrier 500 as in FIG. 29, so that the barrier 500 fixedly and flushly supports the light fixture 10B.

Turning to the modified structure for mounting the W-shaped springs 300, the housing side wall 106 has modified leaf spring apertures 570 each including an open leg portion 572 and foot portion 574. The foot portion 574 is wider axially than the leg portion 572. The leg portions 572 extend circumferentially and flank the adjacent through hole 118B. The toes 312 of the leaf spring 300 extend wider than the axial width of the open leg portion 572 but narrower than the axial extent of the open foot portion 574. The leaf spring 300 has a relaxed length greater than the circumferential spacing of the remote ends of the open leg portions 572.

To install, each leaf spring 300 is bent to enable insertion of its feet 304 into the foot portions 574 of the corresponding pair of leaf spring apertures 570. Then, the spring 300 is released and relaxes with its feet 304 trapped in the remote ends of the open leg portions 572 as shown in FIG. 23A, and its radially inwardly convex central portion 316 pressing its corresponding tongue 338 into the housing interior as above described with respect to FIG. 5.

Variations are contemplated, examples of which follow.

Figure 3:
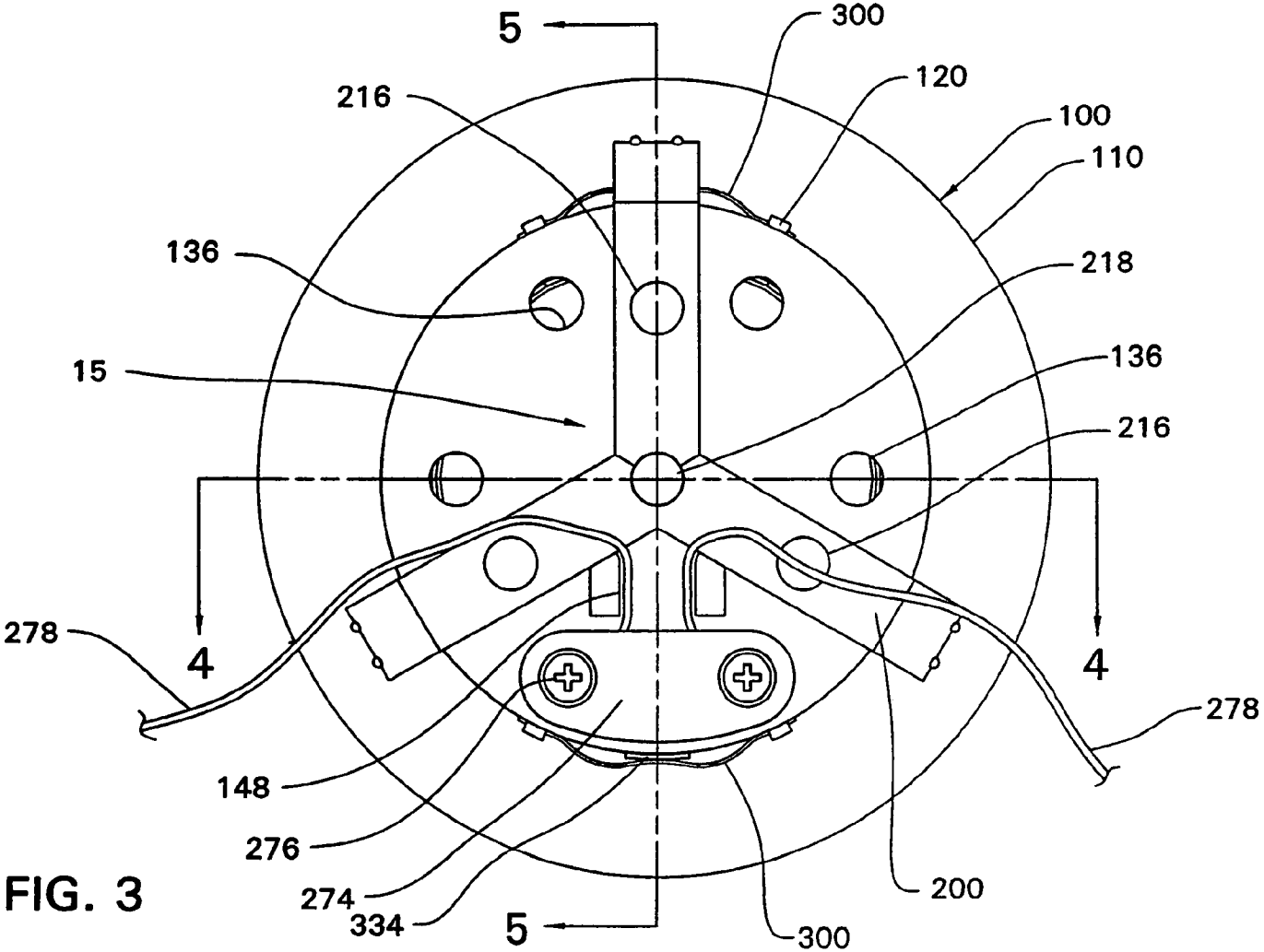
FIG. 3 is a rear view of the FIG. 1 light fixture.
Figure 31:
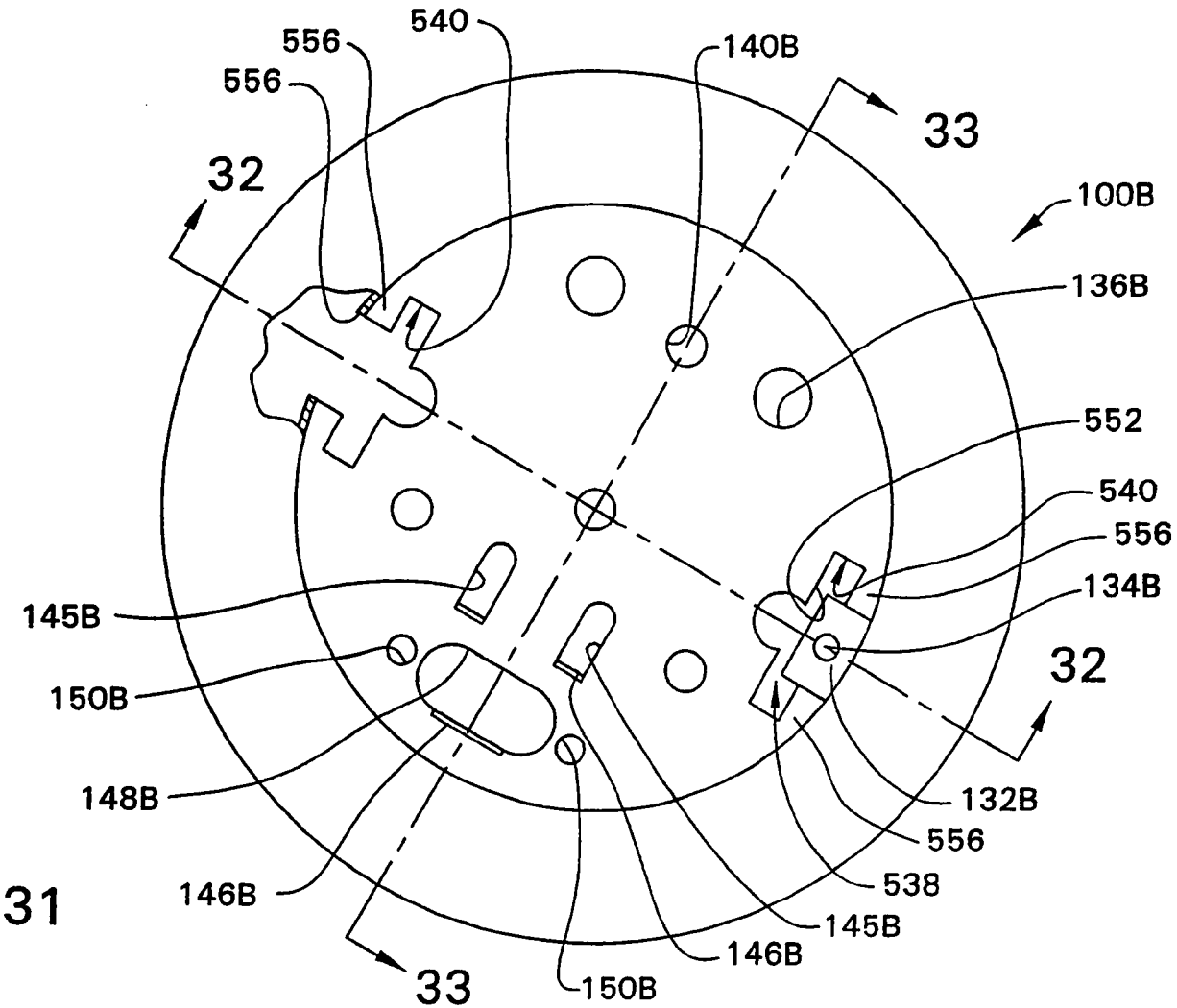
FIG. 31 is a front view of the FIG. 28 housing.
Figure 32:
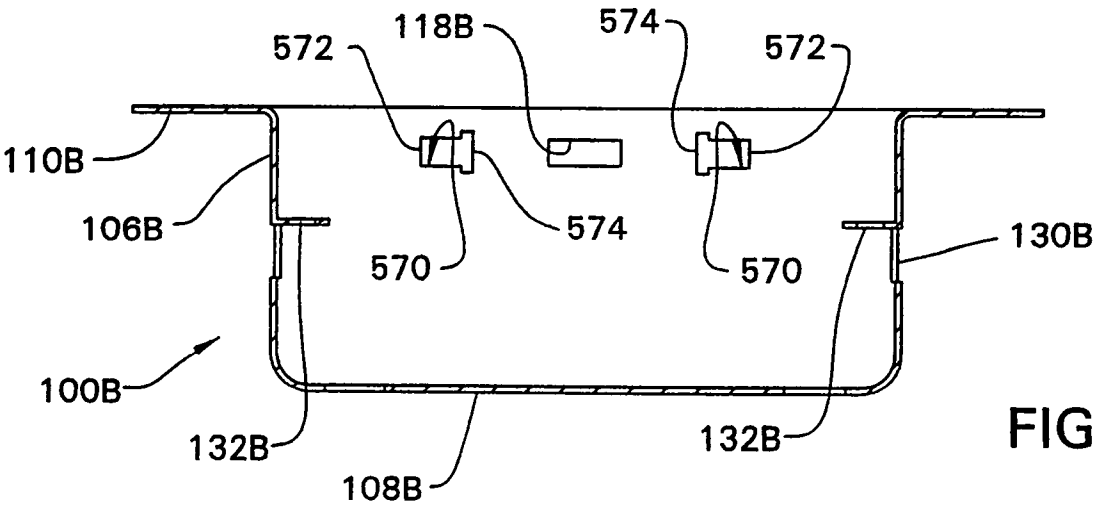
FIG. 32 is a cross sectional view taken substantially on the line 32-32 of FIG. 31.
Figure 32A:
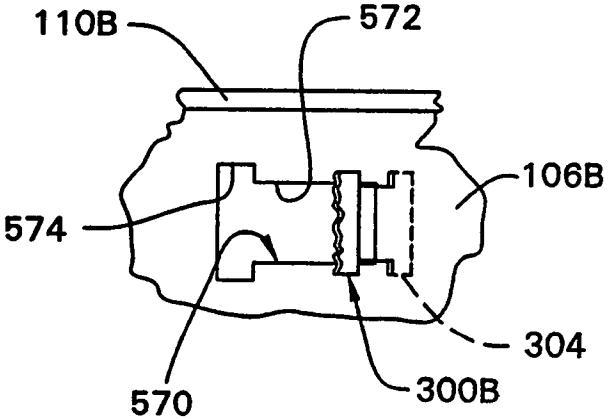
FIG. 32A is a partially broken fragmentary view of part of the housing including a spring aperture and the leaf spring.
Figure 33:
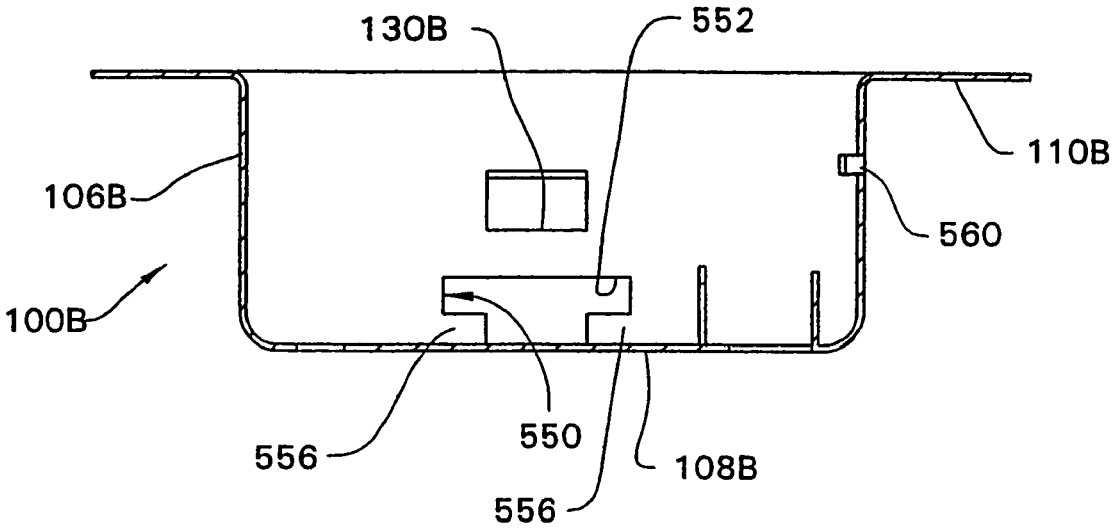
FIG. 33 is a cross sectional view taken substantially on the line 33-33 of FIG. 31.
Figure 34:
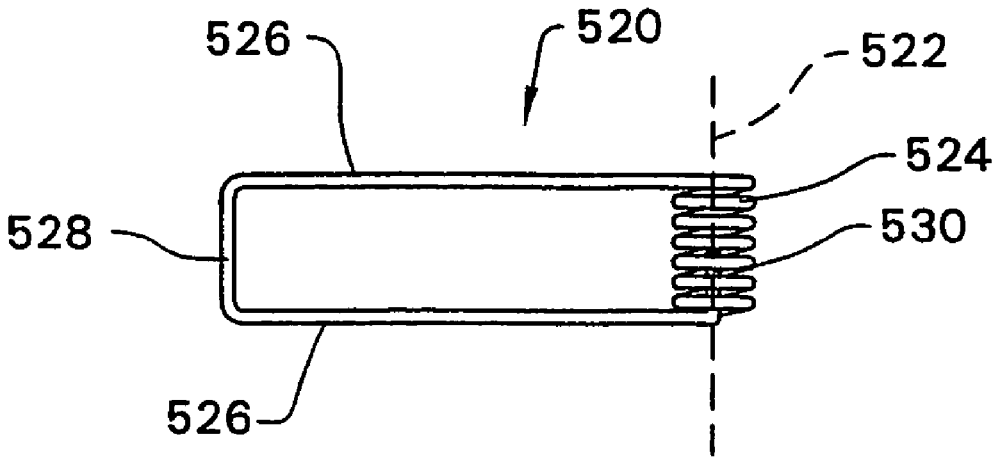
FIG. 34 is a face view of a coil spring member of FIG. 28.
Figure 35:
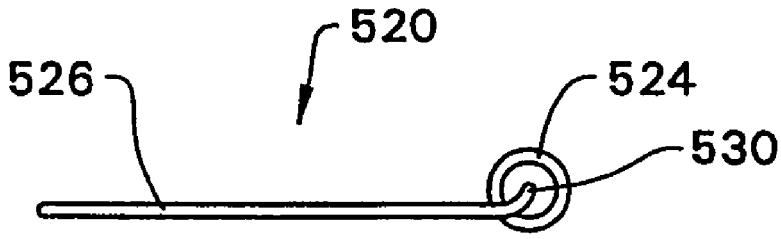
FIG. 35 is an edge view of the coil spring member of FIG. 34.

To reduce inventories, a single housing may alternately employ mounting springs 200 or 520, e.g. by providing the FIG. 31 coil spring holes 540, 550 in the FIG. 3 housing 100.

Where surface, rather than recessed, mounting is required, the recessed housings 100, etc. may be substituted by a suitable surface mount housing, e.g. a housing generally like at 100 or 100B but with a skirt extending from the periphery of the flange 110, spaced radially outboard of and loosely substantially surrounding the cuplike portion 104, although this disadvantageously looses a primary aesthetic advantage of the recessed FIG. 1-35 embodiments, e.g. a glowing lens is no longer the only visable structure.

Also, where multiple (e.g. dual) light sources and/or reflectors are required, the housing (as at 100) and lens may be widened to accommodate same, or multiple adjacent lenses may be mounted on adjacent or interconnected housings or on a widened housing, although disadvantageously with additional complexity and cost.

Also contemplated are other means for mounting of the lens on the housing, such as snap fit or screw-in mounts, although at the risk of insecure mounting and/or manufacturing tolerance problems. Also contemplated are modified tongue-in-groove, or bayonet, lens/housing connections, e.g. providing a tongue on the lens and a receiving groove structure on the housing, and/or spring loading the groove structure rather than the tongue, but these disadvantageously may raise serious design, manufacturing and cost problems.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A light fixture, comprising:

a housing having a front opening and a housing side wall;

a light source in said housing and visible from said front opening;

a light transmitting lens opposing said front opening of said housing, said light transmitting lens having a radial flange and an axially inward extending skirt, said skirt laterally opposing said housing side wall;

mounting structure operatively interposed between said lens skirt and housing side wall and comprising (1) a projecting tongue, (2) a groove sized to receive said tongue, (3) resilient structure resiliently maintaining interlocked relation between said groove and tongue;

said groove being disposed in said skirt and including a rearward opening entry channel and a circumferential channel extending from said entry channel, said tongue being movably mounted on said housing side wall and resiliently biased into said groove, said housing and lens having relative positions wherein (1) said skirt is forward of said tongue, (2) said tongue opposes one portion on said skirt and is resiliently bottomed in said entry channel and (3) said tongue opposes a laterally offset portion of said skirt and is resiliently bottomed in said circumferential channel, said resilient structure comprising a resilient member operatively interposed between said side wall and said tongue and biasing said tongue toward said groove; and said resilient member comprising a leaf spring having ends carried on the outer face of said housing side wall and a central portion radially inwardly biasing said tongue, said side wall having a through opening, said tongue extending through said through opening from said leaf spring toward said lens skirt.

2. The light fixture of claim 1, wherein said skirt is laterally spaced from said side wall at any of a first range of distances and said groove has any of a second range of depths, and said tongue is resiliently bottomed in said groove.

3. The light fixture, comprising:

a housing having a front opening and a rearward extending housing side wall;

a light source in said housing and visible from said front opening;

a light transmitting lens at said front opening of said housing, said light transmitting lens having a radial flange extending radially beyond said front opening and a skirt extending rearward into said housing, said skirt laterally opposing said housing side wall;

an indentation in the outer peripheral surface of said skirt and spaced from a rear edge of said skirt;

a projection, said housing side wall carrying a projection support portion, said projection being laterally inwardly movably mounted with respect to said housing side wall adjacent said housing front opening and including an inboard portion removably disposed in a latching position in said indentation to latch said lens on said housing;

said projection comprising a substantially radially inward extending tongue and a spring urging said tongue substantially radially into said indentation; and said indentation being a generally L-shaped groove having an axially extending end opening axially away from said housing front opening and a closed end circumferentially spaced therefrom.

4. The apparatus of claim 3 in which said spring is a leaf spring backed by said housing.

5. The apparatus of claim 3 wherein said light source comprises a light emitter backed by a reflector facing said lens, said light emitter being a high temperature light emitter, namely a halogen bulb close spaced from and directly radiating energy at the inner periphery of said skirt and at said central portion.

6. The apparatus of claim 5 in which said reflector is faceted, said housing side wall having a radially inward projecting portion, said reflector having a radially outward projecting portion overlapping and being fixed to said inward projecting portion adjacent the rear edge of said lens skirt.

7. The apparatus of claim 5 in which said radiating energy comprises visible light and said central and peripheral portions of said lens are seen to glow.

8. The apparatus of claim 2 in which said lens is a boron silicate glass casting.

9. The apparatus of claim 8 in which said lens central portion is of substantially constant thickness.

10. A light fixture for substantially flush mounting in an aperture of an environmental barrier, defined by front and rear barrier surfaces, to illuminate an environmental space in front of said front barrier surface, said light fixture comprising:

a housing having a peripheral housing flange, which extends radially sidewardly between inner and outer flange edges and defines radially extending front and rear flange faces, and a peripheral housing side wall, which extends rearwardly from said housing flange and has radially facing outer and inner wall faces that define a housing interior, said inner wall face and said inner flange edge defining a periphery of a front opening which said front opening opens forwardly and provides access to said housing interior;

said housing further including radially movable bearing members mounted thereon which are biased outwardly so as to bear against said barrier and are movable inwardly toward said housing side wall to permit insertion of said light fixture into said barrier aperture, said bearing members being rearwardly spaced from said rear flange face to define a barrier receiving space which opens sidewardly for receiving an edge of said barrier aperture between said rear flange face and said bearing members with said bearing members positioned for bearing engagement with said barrier to trap said rear flange face against said barrier front face and hold said housing in said aperture;

a light source in said housing and visible through said front opening;

a one-piece, light transmitting lens at said front opening of said housing and axially opposing said front opening of said housing and said light source;

wherein said light transmitting lens has a directly illuminated central portion having an inside central face in line of sight relation with said light source and providing direct light paths from said light source;

an indirectly illuminated radial flange extending radially beyond said front opening in out of line of sight relation with said light source and providing indirect light paths which are bent in a generally radial direction outward from said central portion of said light transmitting lens, said radial flange hiding said housing flange wherein that visible part of said light fixture viewable from an environmental space is defined substantially by said light transmitting lens with said housing being hidden by said central portion and said radial flange; and a directly illuminated skirt extending rearward and interiorly into said housing, said skirt having an outer peripheral skirt face laterally opposing said housing side wall and an inner peripheral skirt face spaced inwardly from said housing side wall and disposed in line of sight relation with said light source to provide light paths extending to said central portion and said peripheral portion;

wherein said light source further comprises a light emitter backed by a reflector facing said light transmitting lens, said reflector having a forward opening bowl defining a concave reflective surface which extends forwardly and terminates at a forward reflector edge that is closely adjacent and substantially flush with said inner peripheral skirt face such that said light radiating from said light emitter is emitted directly to or is reflected to said inner peripheral skirt face and said inside central face to directly illuminate said central portion and indirectly illuminate said radial flange of said light transmitting lens;

said light transmitting lens is made of cast, heat-resistant glass and said light emitter is a halogen bulb; and said outer peripheral skirt face includes an indentation in the outer peripheral surface of said skirt and spaced from the rear edge of said skirt, said housing including a projection, wherein said housing side wall carries a projection support portion such that said projection is laterally inwardly movably mounted with respect to said housing side wall adjacent said housing front opening, said projection including an inboard portion removably disposed in a lateraling position in said indentation to removably latch said lens on said housing.

11. A light fixture for substantially flush mounting in an aperture of an environmental barrier, defined by front and rear barrier surfaces, to illuminate an environmental space in front of said front barrier surface, said light fixture comprising:

a housing having a peripheral housing flange, which extends radially sidewardly between inner and outer flange edges and defines radially extending front and rear flange faces, and a peripheral housing side wall, which extends rearwardly from said housing flange and has radially facing outer and inner wall faces that define a housing interior, said inner wall face and said inner flange edge defining a periphery of a front opening which said front opening opens forwardly and provides access to said housing interior;

said housing further including radially movable bearing members mounted thereon which are biased outwardly so as to bear against said barrier and are movable inwardly toward said housing side wall to permit insertion of said light fixture into said barrier aperture, said bearing members being rearwardly spaced from said rear flange face to define a barrier receiving space which opens sidewardly for receiving an edge of said barrier aperture between said rear flange face and said bearing members with said bearing members positioned for bearing engagement with said barrier to trap said rear flange face against said barrier front face and hold said housing in said aperture;

a light source in said housing and visible through said front opening;

a one-piece, light transmitting lens at said front opening of said housing and axially opposing said front opening of said housing and said light source;

wherein said light transmitting lens has a directly illuminated central portion having an inside central face in line of sight relation with said light source and providing direct light paths from said light source;

an indirectly illuminated radial flange extending radially beyond said front opening in out of line of sight relation with said light source and providing indirect light paths which are bent in a, generally radial direction outward from said central portion of said light transmitting lens, said radial flange hiding said housing flange wherein that visible part of said light fixture viewable from an environmental space is defined substantially by said light transmitting lens with said housing being hidden by said central portion and said radial flange; and a directly illuminated skirt extending rearward and interiorly into said housing, said skirt having an outer peripheral skirt face laterally opposing said housing side wall and an inner peripheral skirt face spaced inwardly from said housing side wall and disposed in line of sight relation with said light source to provide light paths extending to said central portion and said peripheral portion;

wherein said light source further comprises a light emitter backed by a reflector facing said light transmitting lens, said reflector having a forward opening bowl defining a concave reflective surface which extends forwardly and terminates at a forward reflector edge that is closely adjacent and substantially flush with said inner peripheral skirt face such that said light radiating from said light emitter is emitted directly to or is reflected to said inner peripheral skirt face and said inside central face to directly illuminate said central portion and indirectly illuminate said radial flange of said light transmitting lens; and said light fixture includes mounting structure operatively interposed between said lens skirt and housing side wall and comprising a projecting tongue, a groove sized to receive said tongue, and resilient structure resiliently maintaining interlocked relation between said groove and tongue, said tongue and resilient structure being mounted on said housing side wall having a low radial profile so as to be located laterally adjacent said lens skirt and radially adjacent said barrier receiving space without interference with said barrier.

12. The light fixture of claim 11, wherein said resilient member comprises a leaf spring having ends carried on the outer face of said housing side wall and a central portion extending circumferentially about said outer side wall face and radially inwardly biasing said tongue, said side wall having a through opening, said tongue extending through said through opening from said leaf spring toward said lens skirt.

13. The light fixture of claim 12, wherein a gasket is sandwiched axially between the radial flange and an environmental barrier to seal moisture from said housing.

* * * * *